US008242963B2

(12) United States Patent
Miyashita

(10) Patent No.: US 8,242,963 B2
(45) Date of Patent: Aug. 14, 2012

(54) ANTENNA DEVICE

(75) Inventor: Norihiro Miyashita, Shiga (JP)

(73) Assignee: Panasonic Corporation, Osaka (JP)

( * ) Notice: Subject to any disclaimer, the term of this patent is extended or adjusted under 35 U.S.C. 154(b) by 291 days.

(21) Appl. No.: 12/671,875

(22) PCT Filed: Aug. 1, 2008

(86) PCT No.: PCT/JP2008/002093

§ 371 (c)(1),
(2), (4) Date: Feb. 2, 2010

(87) PCT Pub. No.: WO2009/019850

PCT Pub. Date: Feb. 12, 2009

(65) Prior Publication Data

US 2011/0195661 A1 Aug. 11, 2011

(30) Foreign Application Priority Data

Aug. 3, 2007 (WO) ..... PCT/JP2007/065258
Dec. 4, 2007 (JP) ..... P2007-313258
Jun. 30, 2008 (JP) ..... P2008-170088

(51) Int. Cl.
*H01Q 1/24* (2006.01)
*H01Q 11/12* (2006.01)
*H01Q 21/00* (2006.01)

(52) U.S. Cl. ..... 343/702; 343/742; 343/867

(58) Field of Classification Search ..... 343/702, 343/742, 867
See application file for complete search history.

(56) References Cited

U.S. PATENT DOCUMENTS 3,631,500 A 12/1971 Itoh
(Continued)

FOREIGN PATENT DOCUMENTS

CN 1343401 A 4/2002
(Continued)

OTHER PUBLICATIONS

Extended European Search Report for European Application No. 11186781.8, dated Jan. 19, 2012, 5 pages.
(Continued)

*Primary Examiner* — Hoang V Nguyen
(74) *Attorney, Agent, or Firm* — Brinks Hofer Gilson & Lione

(57) ABSTRACT

To provide an antenna device capable of diminishing gain changes caused by a human body. An antenna device has a magnetic current antenna 401 that takes a magnetic current as a source of emission; an electric current antenna 402 that takes an electric current as a source of emission; and an electric current/magnetic current distribution control circuit 403 that feeds signals to the magnetic current antenna 401 and the electric current antenna 402, wherein the magnetic current antenna 401 and the electric current antenna 402 are arranged in such a way that a polarized wave emitted from the magnetic current antenna 401 and a polarized wave emitted from the electric current antenna 402 cross each other at right angles. The electric current/magnetic current distribution control circuit 403 controls distribution of a radio wave emitted from the magnetic current antenna 401 and a radio wave emitted from the electric current antenna 402.

10 Claims, 27 Drawing Sheets

U.S. PATENT DOCUMENTS

| | | | | |
|---|---|---|---|---|
| 5,945,964 | A | | 8/1999 | DeGroot et al. |
| 6,025,813 | A | | 2/2000 | Hately et al. |
| 6,154,177 | A | * | 11/2000 | Saito et al. ..... 343/702 |
| 6,271,796 | B1 | | 8/2001 | Itoh et al. |
| 6,437,750 | B1 | | 8/2002 | Grimes et al. |
| 6,459,412 | B1 | | 10/2002 | Koyanagi et al. |
| 6,954,180 | B1 | | 10/2005 | Braun et al. |
| 7,250,910 | B2 | | 7/2007 | Yoshikawa et al. |
| 2002/0058483 | A1 | | 5/2002 | Shinichi et al. |
| 2005/0162332 | A1 | | 7/2005 | Schantz |
| 2006/0114159 | A1 | | 6/2006 | Yoshikawa et al. |
| 2007/0216584 | A1 | | 9/2007 | Nishikido et al. |
| 2009/0315792 | A1 | | 12/2009 | Miyashita et al. |
| 2011/0195661 | A1 | | 8/2011 | Miyashita |

FOREIGN PATENT DOCUMENTS

| | | | |
|---|---|---|---|
| EP | 1168658 | A1 | 1/2002 |
| EP | 2051328 | A1 | 4/2009 |
| GB | 2288914 | A | 11/1995 |
| JP | 11-136020 | A | 5/1999 |
| JP | 2000-077934 | A | 3/2000 |
| JP | 2000-244219 | A | 9/2000 |
| JP | 2001-156517 | A | 6/2001 |
| JP | 2002-152115 | A | 5/2002 |
| JP | 2002-176380 | A | 6/2002 |
| JP | 2005-109609 | A | 4/2005 |
| JP | 3735635 | B2 | 10/2005 |
| JP | 2005-347855 | A | 12/2005 |
| RU | 2173495 | C2 | 9/2001 |
| RU | 2220481 | C2 | 12/2003 |
| RU | 2247449 | C2 | 2/2005 |
| WO | WO 01/31734 | A1 | 5/2001 |
| WO | WO 2004/070879 | A1 | 8/2004 |

OTHER PUBLICATIONS

International Search Report for International Application No. PCT/JP2008/002093, dated Nov. 4, 2008, 2 pages.

Extended European Search Report for European Application No. 08790357.1, dated Apr. 20, 2011, 9 pages.

Decision on Grant for counterpart Russian Application No. 2010103511/07, dated Apr. 6, 2012, 16 pages (with English translation).

* cited by examiner

HORIZONTAL POLARIZED WAVE
VERTICAL POLARIZED WAVE

XPR = 6dB
MEG[dBi]
-20
-25
-30
-35
-40
0
50
100
150
200
250
300
350
DISTANCE FROM HUMAN BODY [mm]

XPR = 0dB
MEG[dBi]
-20
-25
-30
-35
-40
0
50
100
150
200
250
300
350
DISTANCE FROM HUMAN BODY [mm]
α1 - α2 = 0DEG
α1 - α2 = 30DEG
α1 - α2 = 60DEG
α1 - α2 = 90DEG
α1 - α2 = 120DEG
α1 - α2 = 150DEG
α1 - α2 = 180DEG

XPR = -6dB
MEG[dBi]
-20
-25
-30
-35
-40
0
50
100
150
200
250
300
350
DISTANCE FROM HUMAN BODY [mm]

FIG. 26

| ATTITUDE OF ANTENNA | XPR | FEED PHASE DIFFERENCE |
|---|---|---|
| LOOP PLANES OF LOOP ANTENNAS 107 AND 108 HORIZONTAL TO X-Y PLANE | 1.5dB OR MORE | 180° |
| | -1.5dB OR MORE LESS THAN 1.5dB | 150° |
| | -4.5dB OR MORE LESS THAN -1.5dB | 120° |
| | -7.5dB OR MORE LESS THAN -4.5dB | 90° |
| | LESS THAN -7.5dB | 60° |
| LOOP PLANES OF LOOP ANTENNAS 107 AND 108 PERPENDICULAR TO X-Y PLANE | 4.5dB OR MORE | 30° |
| | 1.5dB OR MORE LESS THAN 4.5dB | 60° |
| | -4.5dB OR MORE LESS THAN 1.5dB | 90° |
| | -7.5dB OR MORE LESS THAN -4.5dB | 120° |
| | LESS THAN -7.5dB | 180° |

ANTENNA DEVICE

TECHNICAL FIELD

The present invention relates to an antenna device using a loop antenna element.

BACKGROUND ART

In order to ensure information security, development of a wireless personal identification technique typified by SPC (Secure Private Cosm) has recently been pursued. Two-way authentication and RSSI (Received Signal Strength Indicator)-based distance detection are performed between an authentication key that is worn by a user and that has a wireless communication function and a controlled apparatus equipped with a wireless communication function, such as a personal computer, a portable phone, and a car. It is determined from the intensity of an RSSI whether or not a controlled apparatus is in an authentication area (a radius of several meters from an authentication key), and a functional lock to the controlled apparatus and operation of a warning buzzer are controlled. A function for preventing unauthorized utilization of the apparatus or mislaying of the apparatus is thereby fulfilled. When the authentication area is too narrow, the function lock or the warning buzzer is activated during the course of use of the apparatus. On the contrary, when the authentication area is too wide, security is deteriorated. Accordingly, it is desirable that the authentication area be a constant size.

However, there has been a problem of an antenna gain varying according to a distance between the authentication key and a human body, which in turn changes the size of the authentication area.

A related method for avoiding influence of a conductor, such as a human body, on an antenna is to use a loop antenna having a structure in which a loop plane is perpendicular to a conductor in order to avoid occurrence of a steep drop in gain even when the conductor gets closer to the antenna (see Patent Document 1 [FIG. 1], Patent Document 2 [FIG. 2], and Patent Document 3).

Patent Document 1: JP-A-2000-244219
Patent Document 2: JP-A-2005-109609
Patent Document 3: JP-B-3735635

DISCLOSURE OF THE INVENTION

Problem that the Invention is to Solve

However, under the methods described in connection with Related-art Patent Documents 1, 2, and 3, an antenna gains varies according to a distance between the antenna and a human body or a conductor.

The present invention has been conceived in light of the related-art problem and aims at providing antenna capable of diminishing a change in gain caused by the human body.

Means for Solving the Problem

To solve the problem, an antenna device of the present invention includes a magnetic current antenna which uses a magnetic current as an emission source; an electric current antenna which uses an electric current as an emission source; and a signal feeding section that supplies signals to the magnetic current antenna and the electric current antenna, wherein the magnetic current antenna and the electric current antenna are arranged so that a polarized wave emitted from the magnetic current antenna is perpendicular to a polarized wave emitted from the electric current antenna; and wherein the signal feeding section controls distribution of a radio wave emitted from the magnetic current antenna and a radio wave emitted from the electric current antenna.

Advantage of the Invention

As mentioned above, the present invention makes it possible to realize an antenna device capable of reducing gain changes caused by a human body.

BRIEF DESCRIPTION OF THE DRAWINGS

FIG. 6(*b*) is a view showing an example configuration of the loop antennas 107 and 108 and the ground lines 109 achieved when loop planes of the respective loop antenna 107 and 108 lie in an X-Y plane and when each of the loop antennas 107 and 108 is provided with a ground line in the first embodiment of the present invention; and FIG. 6(*c*) is a view showing an example configuration of the loop antennas 107 and 108 and the ground line 109 achieved when the loop planes of the respective loop antennas 107 and 108 lie within the X-Y plane and when a ground line is shared between the loop antennas in the first embodiment of the present invention.

FIG. 15(*b*) is a view showing a change in average gain of the X-Y plane with respect to the distance between the antenna device and the human body model 301 arising when the loop planes of the loop antennas 107 and 108 are horizontal to the X-Y plane with a feed phase difference of 90° in the first embodiment of the present invention; and FIG. 15(*c*) is a view showing a change in average gain of the X-Y plane with respect to the distance between the antenna device and the human body model 301 arising when the loop planes of the loop antennas 107 and 108 are horizontal to the X-Y plane with a feed phase difference of 180° in the first embodiment of the present invention.

FIG. 16(*b*) is a view showing a change in MEG with respect to the distance between the antenna device and the human body arising when the loop planes of the loop antennas 107 and 108 are horizontal to the X-Y plane with XPR=0 dB in the first embodiment of the present invention; and FIG. 16(*c*) is a view showing a change in MEG with respect to the distance between the antenna device and the human body arising when the loop planes of the loop antennas 107 and 108 are horizontal to the X-Y plane with XPR=−6 dB in the first embodiment of the present invention.

FIG. 19(*b*) is a view showing a change in average gain of the X-Y plane with respect to the distance between the antenna device and the human body model 301 arising when the loop planes of the loop antennas 107 and 108 are perpendicular to the X-Y plane with a feed phase difference of 90° in the first embodiment of the present invention; and FIG. 19(*c*) is a view showing a change in average gain of the X-Y plane with respect to the distance between the antenna device and the human body model 301 arising when the loop planes of the loop antennas 107 and 108 are perpendicular to the X-Y plane with a feed phase difference of 180° in the first embodiment of the present invention.

FIG. 20(*b*) is a view showing a change in MEG with respect to the distance between the antenna device and the human body arising when the loop planes of the loop antennas 107 and 108 are perpendicular to the X-Y plane with XPR=0 dB in the first embodiment of the present invention; and FIG. 20(*c*) is a view showing a change in MEG with respect to the distance between the antenna device and the human body arising when the loop planes of the loop antennas 107 and 108 are perpendicular to the X-Y plane with XPR=−6 dB in the first embodiment of the present invention.

FIG. 22(*b*) is a view showing an equivalent circuit of the antenna device of the first embodiment of the present invention, and FIG. 22(*c*) is a view showing an equivalent circuit of the antenna device of the first embodiment of the present invention acquired after conversion.

[FIG. 26] It is a view showing example settings of a feed phase difference of the antenna device of the first embodiment of the present invention.

DESCRIPTIONS OF THE REFERENCE NUMERALS AND SYMBOLS

Figure 1:
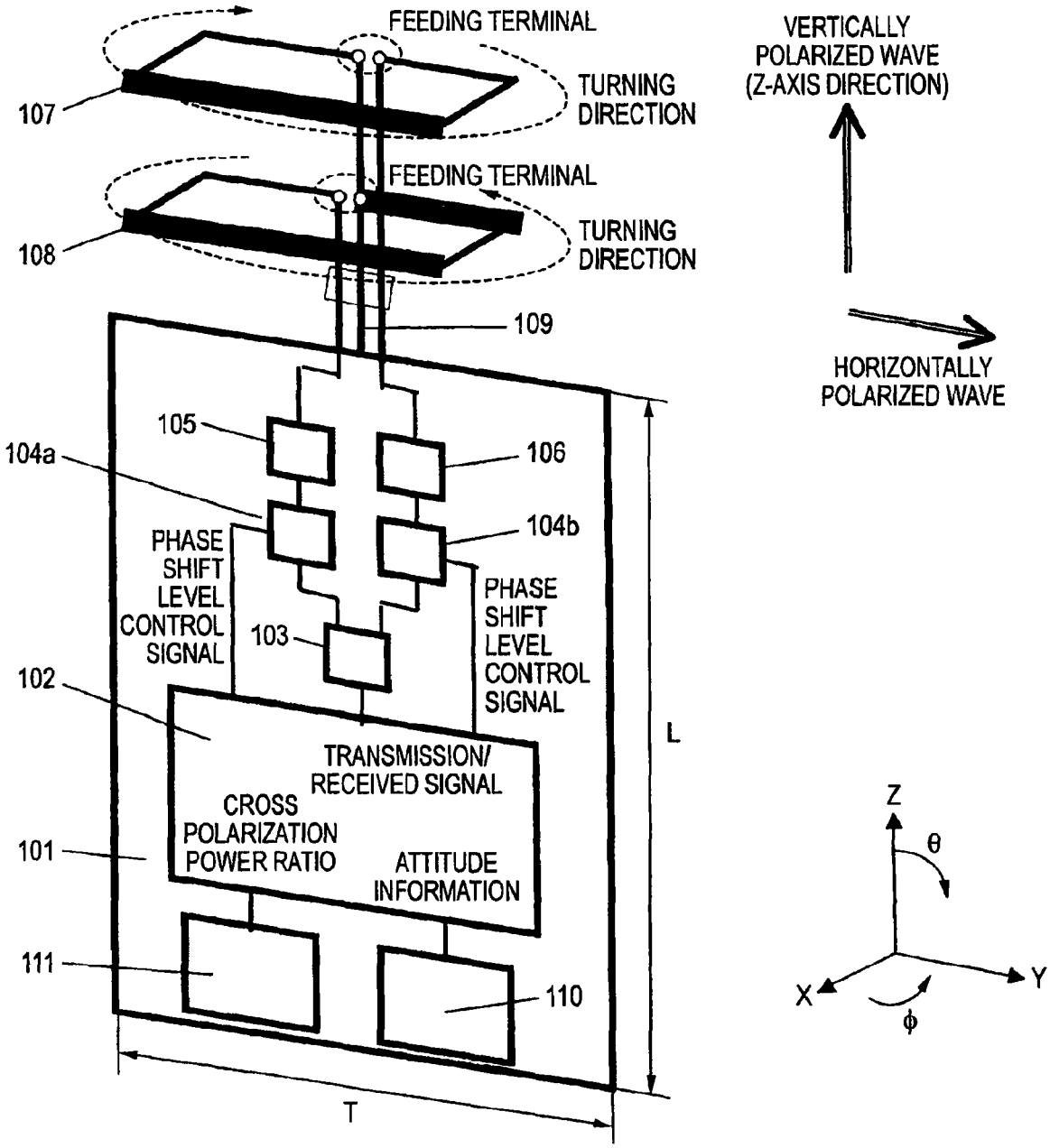
[FIG. 1] It is a view showing a configuration of an antenna device of a first embodiment of the present invention.

101 GROUND PLATE
102 TRANSCEIVER CIRCUIT
103 DISTRIBUTOR
104*a*, 104*b* PHASE SHIFTER
105, 106 MATCHING CIRCUIT
107, 108 LOOP ANTENNA
109 GROUND LINE
110 ATTITUDE SENSOR
111 CROSS POLARIZATION POWER RATIO SENSOR
201, 202, 203 MICRO-LOOP ANTENNA
204 SIGNAL PROCESSING SECTION
301 HUMAN BODY MODEL
401 MAGNETIC CURRENT ANTENNA
402 ELECTRIC CURRENT ANTENNA
403 ELECTRIC/MAGNETIC CURRENT DISTRIBUTION CONTROL CIRCUIT
501 CONTROLLED APPARATUS
502 VERTICALLY-POLARIZED ANTENNA
503 HORIZONTALLY-POLARIZED ANTENNA
504 ATTITUDE SENSOR

BEST MODES FOR IMPLEMENTING THE INVENTION

A first invention is directed to an antenna device comprising: a magnetic current antenna which uses a magnetic current as an emission source; an electric current antenna which uses an electric current as an emission source; and a signal feeding section that supplies signals to the magnetic current antenna and the electric current antenna, wherein the magnetic current antenna and the electric current antenna are arranged so that a polarized wave emitted from the magnetic current antenna is perpendicular to a polarized wave emitted from the electric current antenna; and wherein the signal feeding section controls distribution of a radio wave emitted from the magnetic current antenna and a radio wave emitted from the electric current antenna.

The configuration makes it possible to implement an antenna device with small gain variations caused by a human body.

A second invention is directed to the antenna device of the first invention further comprising an attitude sensing section that detects an inclination of a ground plate on which the signal feeding section is provided with respect to a reference plane. The signal feeding section controls the distribution of the radio wave emitted from the magnetic current antenna and the radio wave emitted from the electric current antenna in accordance with the inclination detected by the attitude sensing section.

The configuration makes it possible to implement an antenna device with small gain variations caused by a human body even when the inclination of the antenna device is changed.

A third invention is directed to the antenna device of the first or second invention, wherein the signal feeding section controls the distribution of the radio wave emitted from the magnetic current antenna and the radio wave emitted from the electric current antenna in accordance with information about an inclination of a wireless apparatus with respect to a reference plane, the information being included in an incoming radio wave from the wireless apparatus.

The configuration makes it possible to implement an antenna device with small gain variations caused by a human body even when the inclination of a wireless apparatus is changed.

A fourth invention is directed to the antenna device of the second or third invention further comprising a cross polarization power ratio sensing section that detects a cross polarization power ratio of an incoming radio wave from a wireless apparatus. The signal feeding section controls the distribution of the radio wave emitted from the magnetic current antenna and the radio wave emitted from the electric current antenna in accordance with the cross polarization power ratio detected by the cross polarization power ratio sensing section.

The configuration makes it possible to implement an antenna device with small gain variations caused by a human body even when the cross polarization power ratio of the incoming radio wave has changed.

A fifth invention is directed to the antenna device of the second or third invention, wherein, when a vertically polarized component and a horizontally polarized component in an incoming radio wave from a wireless apparatus are substantially identical with each other, the signal feeding section controls the distribution of the radio wave emitted from the magnetic current antenna and the radio wave emitted from the electric current antenna in accordance with a preset distribution.

The configuration makes it possible to implement an antenna device with small gain variations caused by a human body without processing for detecting the cross polarization power ratio and the information about the inclination of the wireless apparatus.

A sixth invention is directed to the antenna device of any one of the second to fifth inventions, wherein the signal feeding section controls the distribution of the radio wave emitted from the magnetic current antenna and the radio wave emitted from the electric current antenna so that a margin of gain change falls within a predetermined range.

The configuration makes it possible to implement an antenna device in which the margin of the gain changes caused by the human body falls within the predetermined range at all times.

A seventh invention is directed to an antenna device comprising a planar ground plate having a ground conductor; a first loop antenna and a second loop antenna provided at positions separate from the ground plate in a horizontal direction; and a signal feeding section that feeds signals to feeding points provided at one ends of the first loop antenna and the second loop antenna respectively, wherein loop planes formed respectively in the first loop antenna and the second loop antenna are perpendicular to the ground plate; wherein other ends of the first loop antenna and the second loop antenna are coupled to the ground plate respectively; wherein a turning direction of the first loop antenna from the feeding point thereof to the ground plate is opposite to a turning direction of the second loop antenna from the feeding point thereof to the ground plate; and wherein polarized waves parallel to the loop planes emitted from the first loop antenna and the second loop antenna are perpendicular to a polarized wave emitted by electric currents flowing from the first loop antenna and the second loop antenna into the ground plate.

The configuration makes it possible to realize an antenna including a magnetic current antenna component and an electric current antenna component, polarized waves of which cross each other at right angles.

An eighth invention is directed to the antenna device of the seventh invention, wherein the loop plane formed by the first loop antenna faces the loop plane formed by the second loop antenna.

The configuration makes it possible to make the plane of polarization of the first loop antenna operating as the magnetic current antenna identical with the plane of polarization of the second loop antenna.

A ninth invention is directed to the antenna device of the eighth invention, wherein the first loop antenna and the second loop antenna are arranged at a position where an amount of mutual coupling between the first loop antenna and the second loop antenna becomes −10 dB or less.

The configuration makes it possible to change the phase of the signal fed to the first loop antenna and the phase of the signal fed to the second loop antenna without collapse of impedance matching between the antennas.

A tenth invention is directed to the antenna device of the ninth invention, wherein the signal feeding section controls a phase of the signal fed to the first loop antenna and a phase of the signal fed to the second loop antenna.

The configuration makes it possible to realize an antenna device using loop antennas with small gain changes caused by the human body.

An eleventh invention is directed to the antenna device of the tenth invention further comprising an attitude sensing section that detects an inclination of the ground plate with respect to a reference plane. The signal feeding section controls the phase of the signal fed to the first loop antenna and the phase of the signal fed to the second loop antenna in accordance with the inclination detected by the attitude sensing section.

A twelfth invention is directed to the antenna device of the tenth or eleventh invention, wherein the signal feeding section controls distribution of a radio wave emitted from the first loop antenna and a radio wave emitted from the second loop antenna in accordance with information about an inclination of the wireless apparatus with respect to a reference plane, the information being included in the incoming radio wave from the wireless apparatus.

The configuration makes it possible to implement an antenna device with small gain variations caused by the human body even when the inclination of the wireless apparatus is changed.

The configuration makes it possible to realize an antenna device using loop antennas which involve small gain changes caused by a human body even when a change arises in inclination of the antenna device.

A thirteenth invention is directed to the antenna device of the eleventh or twelfth invention further comprising a cross polarization power ratio sensing section that detects a cross polarization power ratio of an incoming radio wave. The signal feeding section controls the phase of the signal fed to the first loop antenna and the phase of the signal fed to the second loop antenna in accordance with the cross polarization power ratio detected by the cross polarization power ratio sensing section.

The configuration makes it possible to implement an antenna device using the loop antenna with small gain variations caused by the human body even when the cross polarization power ratio of the incoming radio wave has changed.

A fourteenth invention is directed to the antenna device of the eleventh or twelfth invention, wherein, when a vertically polarized component and a horizontally polarized component of an incoming radio wave from a wireless apparatus are substantially identical with each other, the signal feeding section controls the distribution of the radio wave emitted from the first loop antenna and the radio wave emitted from the second loop antenna according to a preset distribution.

The configuration makes it possible to realize the antenna device with small gain changes caused by the human body without processing for detecting the cross polarization power ratio and the information about the inclination of the wireless apparatus.

A fifteenth invention is directed to the antenna device of any one of the eleventh to fourteenth inventions, wherein the signal feeding section controls the phase of the signal fed to the first loop antenna and the phase of the signal fed to the second loop antenna so that a margin of gain change falls within a predetermined range.

The configuration makes it possible to implement an antenna device that uses the loop antennas which let the margin of gain changes caused by the human body fall within the predetermined range at all times.

A sixteenth invention is directed to a wireless communication system comprising the antenna according to any one of the first to fifteenth inventions; and a wireless apparatus that conducts a wireless communication with the antenna device.

The system configuration makes it possible for the antenna device to make small gain changes caused by a human body.

The best mode for implementing the antenna device of the present invention is hereunder described by reference to the drawings; namely, FIGS. 1 through 27. The present invention is not limited to the embodiment.

First Embodiment

Details of a first embodiment of an antenna device of the present invention are hereunder described.

FIG. 1 is a view showing a configuration of the antenna device of the present invention. Reference symbols X, Y, and Z denote coordinate axes, respectively. In FIG. 1, a ground plate 101 has a ground conductor. A longitudinal direction of the ground plate 101 corresponds to a Z-axis direction. Specifically, a length L of the ground plate 101 achieved along the Z-axis direction is larger than a length T of the same achieved along an X-axis direction. The length L of the ground plate 101 may also be substantially equal to the length T of the same.

A transceiver circuit 102 is provided on the ground plate 101; that generates and outputs a transmission signal; and that processes an input received signal. The transceiver circuit 102 can be solely a transmission circuit or a receiving circuit. An attitude sensor 110 to be described later inputs information about an inclination of the antenna device of the present invention to the transceiver circuit 102. Additionally, a cross polarization power ratio sensor 111 to be described later inputs information about a ratio of cross polarization of an incoming radio wave to the transceiver circuit 102. The transceiver circuit 102 outputs a phase shift level control signal for controlling phase shifters 104*a* and 104*b*.

A distributor 103 is provided on the ground plate 101 and has an input terminal connected to the transceiver circuit 102. Also the distributor 103 divides an input signal from the transceiver circuit 102 into two signals by power division, thereby outputting the thus-divided signals. The distributor 103 is made up specifically of a Wilkinson distributor, or the like.

Figure 2:
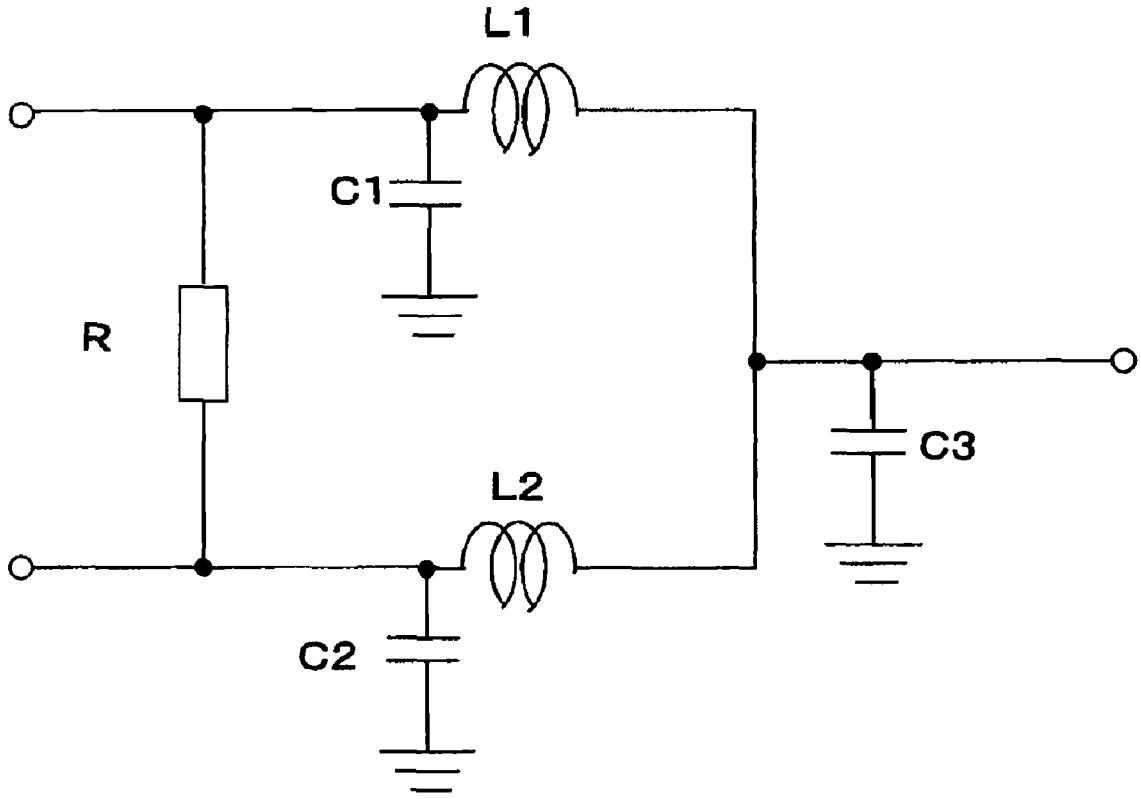
[FIG. 2] It is a view showing an example configuration of the distributor 103 made up of a Wilkinson distributor in the first embodiment of the present invention.

FIG. 2 is a view showing an example configuration of the distributor 103 made up of a Wilkinson distributor. The distributor is built from two series inductors L, three parallel capacitors C, and a resistor R. Since circuitry of the distributor 103 can be built from inductors and capacitors for which chip components are available, the circuitry can be miniaturized when compared with the case of a technique employing a common transmission line.

The phase shifters 104*a* and 104*b* are connected respectively to two output terminals of the transceiver circuit 102 and two output terminals of the distributor 103, and convert a phase of an input signal into a predetermined value in accordance with a phase shift level control signal output from the transceiver circuit 102 to output the thus-converted predetermined value. A feed phase difference between two signals fed to loop antennas 107 and 108 to be described later is thereby changed. Since the essential requirement is that a phase difference between two signals can be changed, only one of the two output terminals of the distributor 103 may also be connected to the phase shifter. When a phase shift level is a fixed value and when control of a phase shift level is not required, a necessity for the phase shift level control signal may also be obviated.

Figure 3:
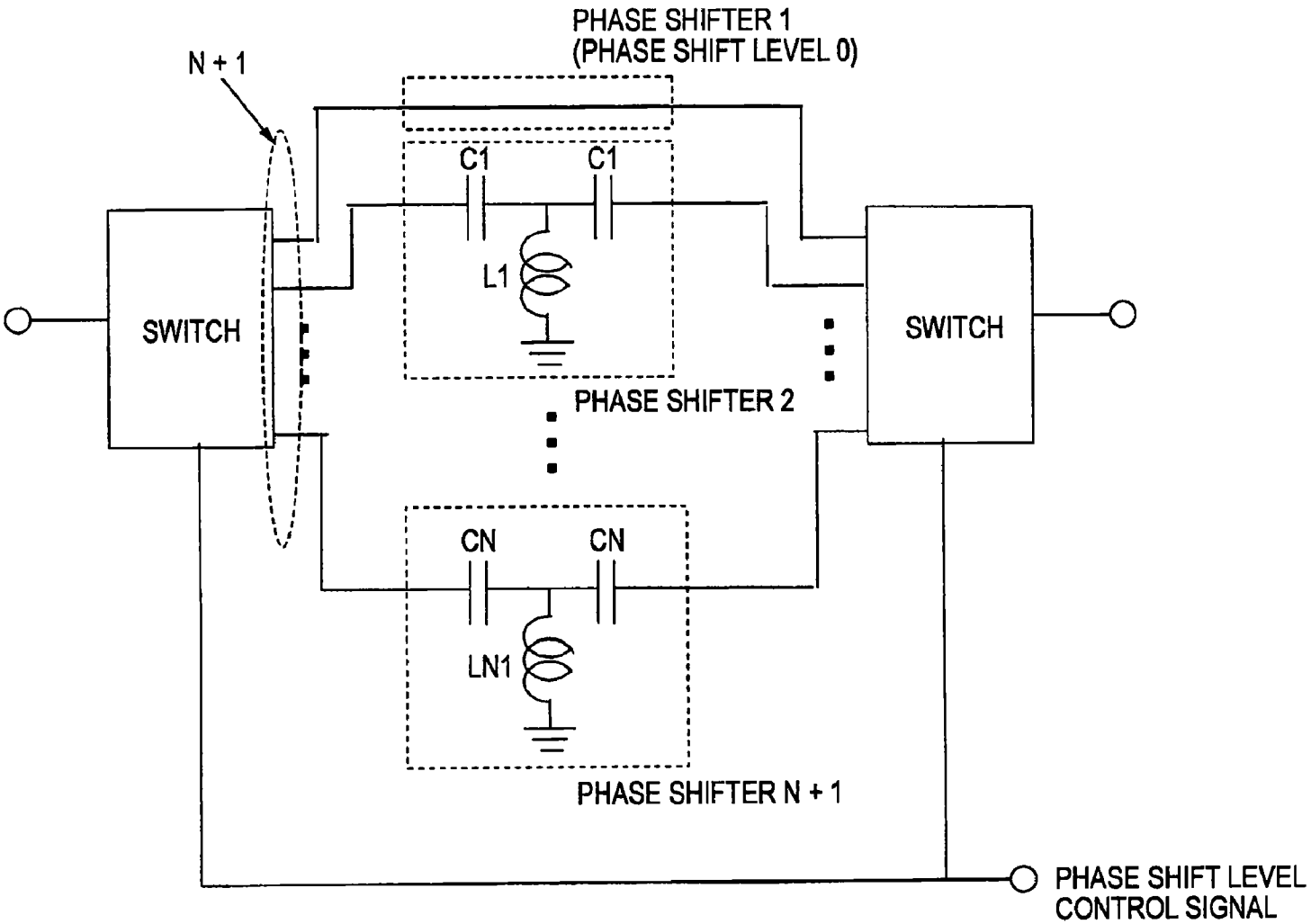
[FIG. 3] It is a view showing an example configuration of phase shifters 104*a* and 104*b* in which a margin of phase changes extends from 0° to 90° in the first embodiment of the present invention.

FIG. 3 is a view showing an example configuration of the phase shifters 104*a* and 104*b* in which a margin of phase changes extends from 0° to 90°. The configuration is implemented by changing a plurality of phase shifters having different phase shift levels through use of switches. Each of the phase shifters is made up of two series capacitors C and one parallel inductor L sandwiched therebetween. When the phase shift level is 0°, input and output terminals of the capacitors are directly coupled together.

Figure 4:
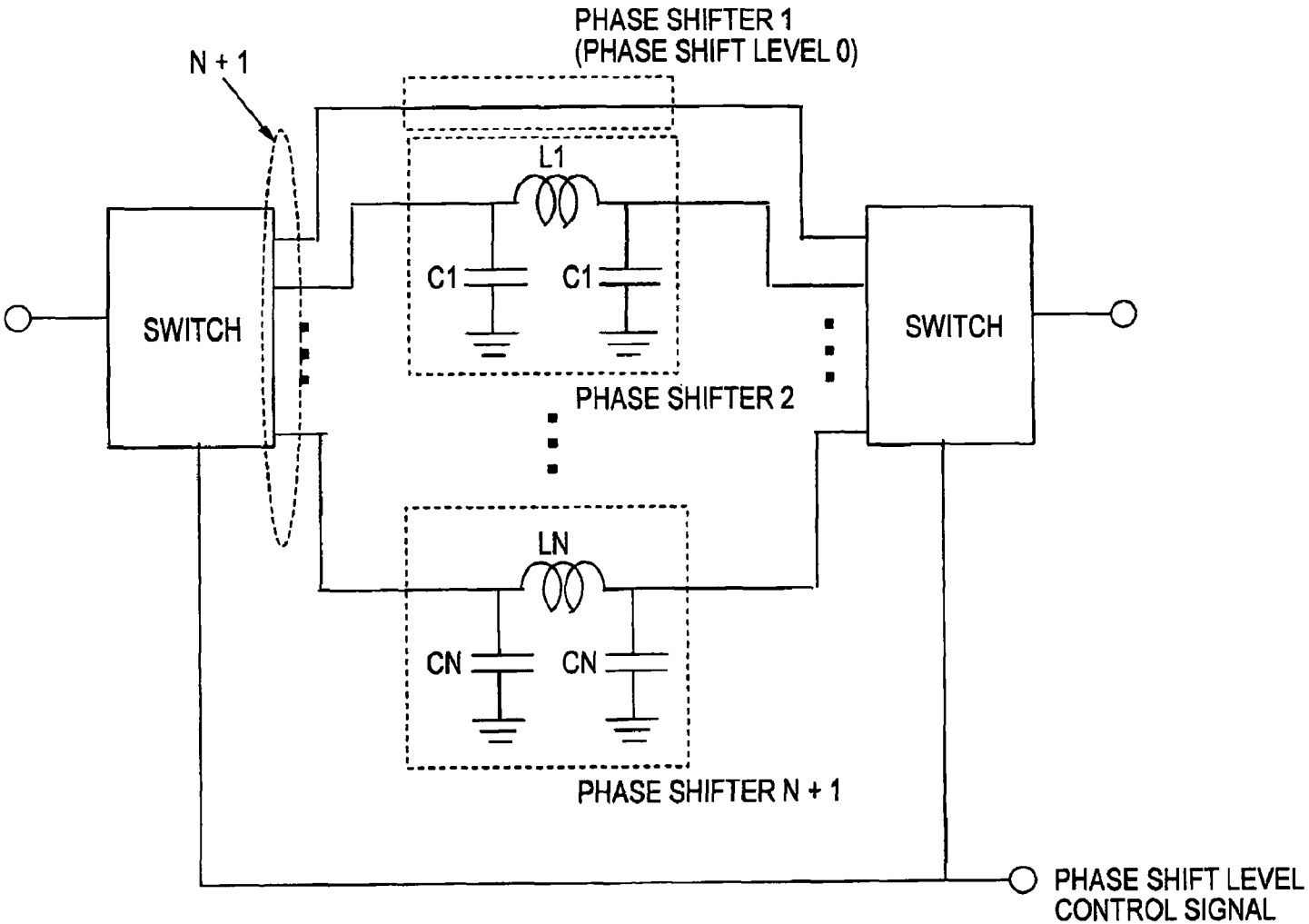
[FIG. 4] It is a view showing an example configuration of the phase shifters 104*a* and 104*b* in which a margin of phase changes extends from 0° to −90° in the first embodiment of the present invention.

FIG. 4 is a view showing an example configuration of the phase shifters 104*a* and 104*b* in which a margin of phase changes extends from 0° to −90°. The configuration is implemented by changing a plurality of phase shifters having different phase shift levels through use of switches. Each of the phase shifters is made up of two parallel capacitors C and one series inductor L sandwiched therebetween. When the phase shift level is 0°, the input and output terminals of the capacitors are directly coupled together.

Since circuitry of each of the phase shifters 104*a* and 104*b* can be built from inductors and capacitors for which chip components are available, the circuitry can be miniaturized when compared with the case of use of common phase shifters that switch delay lines.

A matching circuit 105 is provided on a ground plate 101, and is connected to a loop antenna 108 to be described later and the phase shifter 104*a*. The matching circuit 105 matches impedance of the loop antenna 108 to be described later to that of the phase shifter 104*a* in order to efficiently feed power to the loop antenna 108 to be described later.

A matching circuit 106 is provided on a ground plate 101, and is connected to a loop antenna 107 to be described later and the phase shifter 104*b*. The matching circuit 106 matches impedance of the loop antenna 107 to be described later to that of the phase shifter 104*b* in order to efficiently feed power to the loop antenna 107 to be described later.

Figure 5:
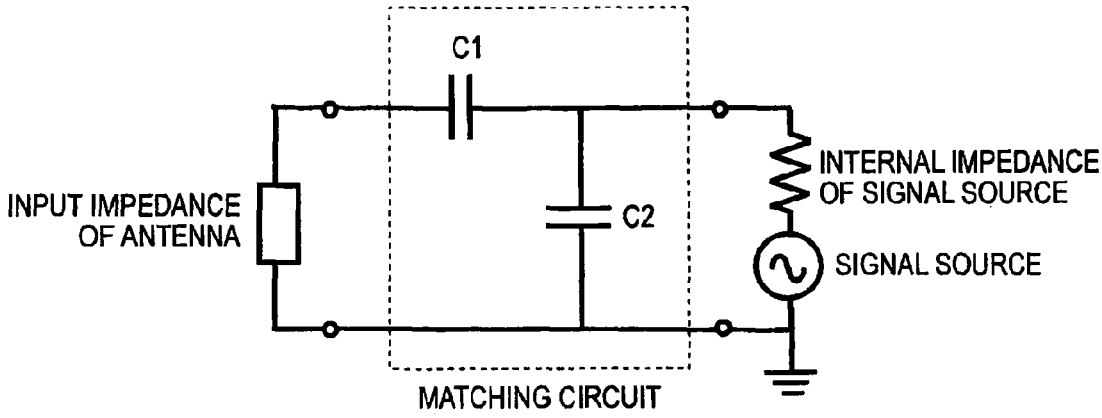
[FIG. 5] FIG. 5(*a*) is a view showing example configurations of matching circuits 105 and 106 in the first embodiment of the present invention, and FIG. 5(*b*) is a view showing example configurations of matching circuits 105 and 106 in the first embodiment of the present invention.
Figure 5:
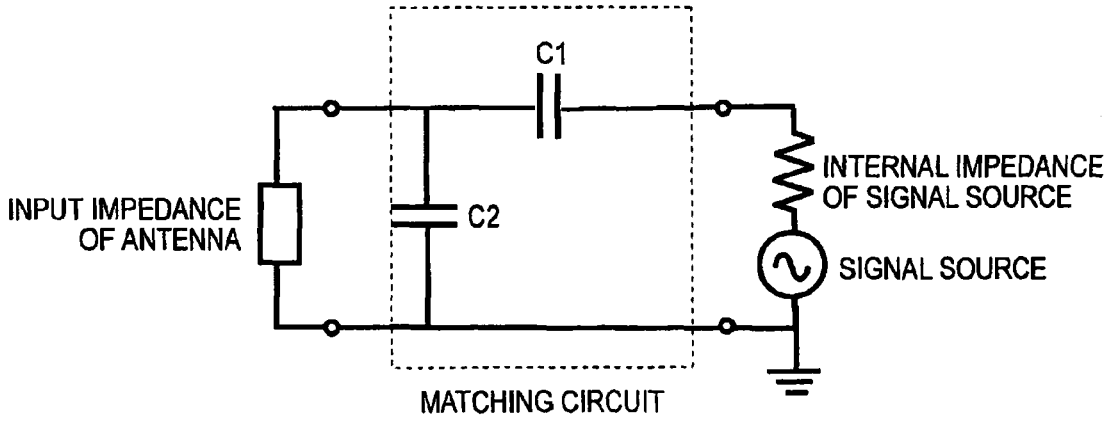

FIGS. 5(*a*) and 5(*b*) are views showing example configurations of the respective matching circuits 105 and 106. Each of the matching circuits is made up of series and parallel capacitors. Since the loop antennas 107 and 108 to be described later exhibit small emission resistance, a matching circuit involving an extremely small loss is required. Since an inductor is greater than a capacitor in terms of a loss, emission resistance is deteriorated when the inductor is used in a matching circuit, whereby a gain significantly decreases. Therefore, it is desirable to form a matching circuit from capacitors.

The loop antenna 107 is provided so that a loop plane formed by the antenna becomes substantially perpendicular to a surface of the ground plate 101, and is made up of a loop-shaped conductor whose two feeding terminals are electrically coupled to the ground plate 101 by way of the matching circuit 106 and a ground line 109 to be described later.

The loop antenna 108 is provided so that a loop plane formed by the antenna becomes substantially perpendicular to a surface of the ground plate 101, and is made up of a loop-shaped conductor whose two feeding terminals are electrically coupled to the ground plate 101 by way of the matching circuit 105 and the ground line 109 to be described later.

The loop antennas 107 and 108 are equal to each other in an axial direction of their loops, and the axial direction of the loops coincides with the longitudinal direction of the ground plate 101.

The entire length of each of the loop antennas 107 and 108 is equal to or less than one wavelength of a radio wave to be transmitted and received. The number of loop turns of each of the loop antennas 107 and 108 is taken as one. However, any number of loop turns is not limited. Moreover, the geometry of the loops of the loop antennas 107 and 108 may also be different from a rectangular shape, such as that shown in FIG. 1. The loop antennas 107 and 108 are provided so as to project from the ground plate 101.

A direction of turn of the loop from a feeding end side (a feeding end side connected to the matching circuit 106) to a ground side (another feeding end side connected to the ground plate 101 by way of the ground line 109 to be described later) of the loop antenna 107 must be different from a direction of turn of the loop from a feeding end side (a feeding end side connected to the matching circuit 105) to a ground side (another feeding end side connected to the ground plate 101 by way of the ground line 109 to be described later) of the loop antenna 108. It is desirable that the loop antennas 107 and 108 are equal in loop size; however, they may also differ from each other.

The ground line 109 electrically connects the respective feeding ends of the loop antennas 107 and 108 to the ground plate 101.

In FIG. 1, the respective terminals of the loop antennas 107 and 108 connected to the ground plate 101 are connected together, to thus form a single terminal. The single terminal is connected to the ground plate 101 by way of the common ground line 109. Alternatively, each of the loop antennas 107 and 108 can also be provided with a ground line, and the loop antennas can also be separately connected to the ground plate 101.

Figure 6:
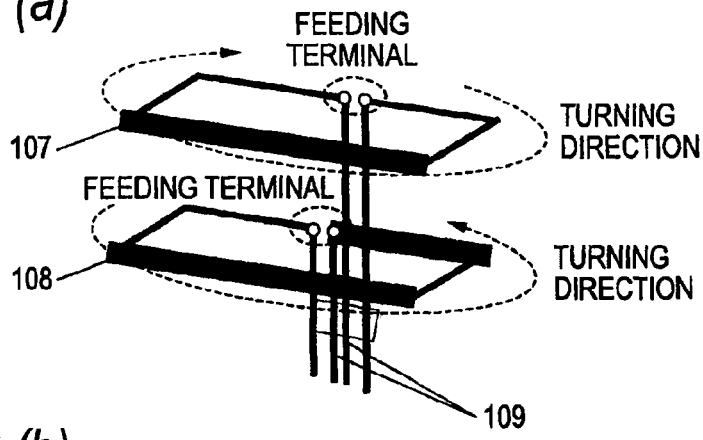
[FIG. 6] FIG. 6(*a*) is a view showing an example configuration of loop antennas 107 and 108 and ground lines 109 achieved when each of the loop antennas 107 and 108 is provided with a ground line in the first embodiment of the present invention.
Figure 6:
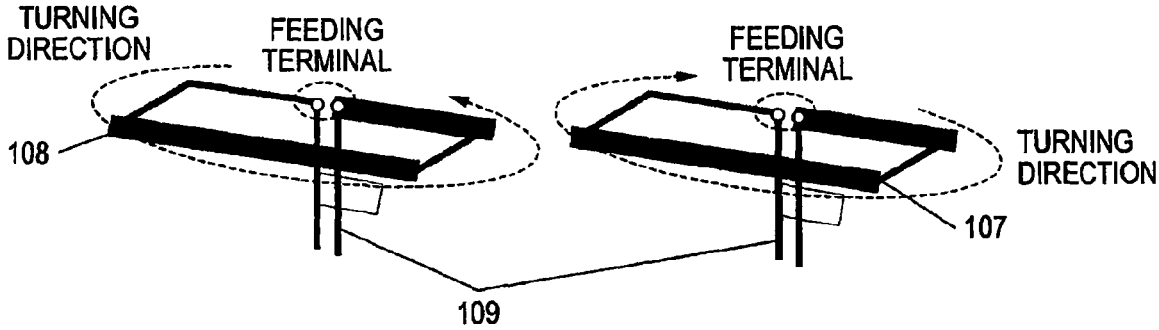
Figure 6:
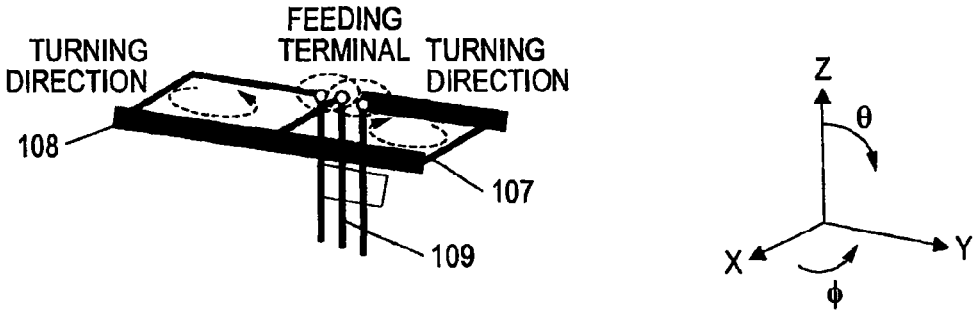

FIG. 6(*a*) is a view showing an example configuration of the loop antennas 107 and 108 and the ground lines 109 achieved when each of the loop antennas 107 and 108 is provided with a ground line. FIG. 6(*b*) is a view showing an example configuration of the loop antennas 107 and 108 and the ground lines 109 achieved when loop planes of the respective loop antenna 107 and 108 lie in an X-Y plane and when each of the loop antennas 107 and 108 is provided with a ground line. FIG. 6(*c*) is a view showing an example configuration of the loop antennas 107 and 108 and the ground line 109 achieved when the loop planes of the respective loop antennas 107 and 108 lie within the X-Y plane and when a ground line is shared between the antennas.

The ground line can also be provided for each of the loop antennas or shared between the loop antennas, as illustrated in FIGS. 6(*a*), 6(*b*), and 6(*c*). Further, the center axis of the loop of the loop antenna 107 and the center axis of the loop of the loop antenna 108 do not need to match each other.

The attitude sensor 110 is provided on the ground plate 101, and detects an inclination of the antenna device of the present invention, thereby outputting inclination information to the transceiver circuit 102. The attitude sensor 110 is specifically built from a sensor capable of detecting an inclination of the antenna with respect to the ground, such as an acceleration sensor and an overturn sensor.

The cross polarization power ratio sensor 111 is provided on the ground plate 101, and detects a ratio of cross polarization power which is a ratio of vertical polarization power to horizontal polarization power of an incoming received radio wave. The cross polarization power ratio sensor 111 outputs information about a ratio of cross polarization to the transceiver circuit 102.

Figure 7:
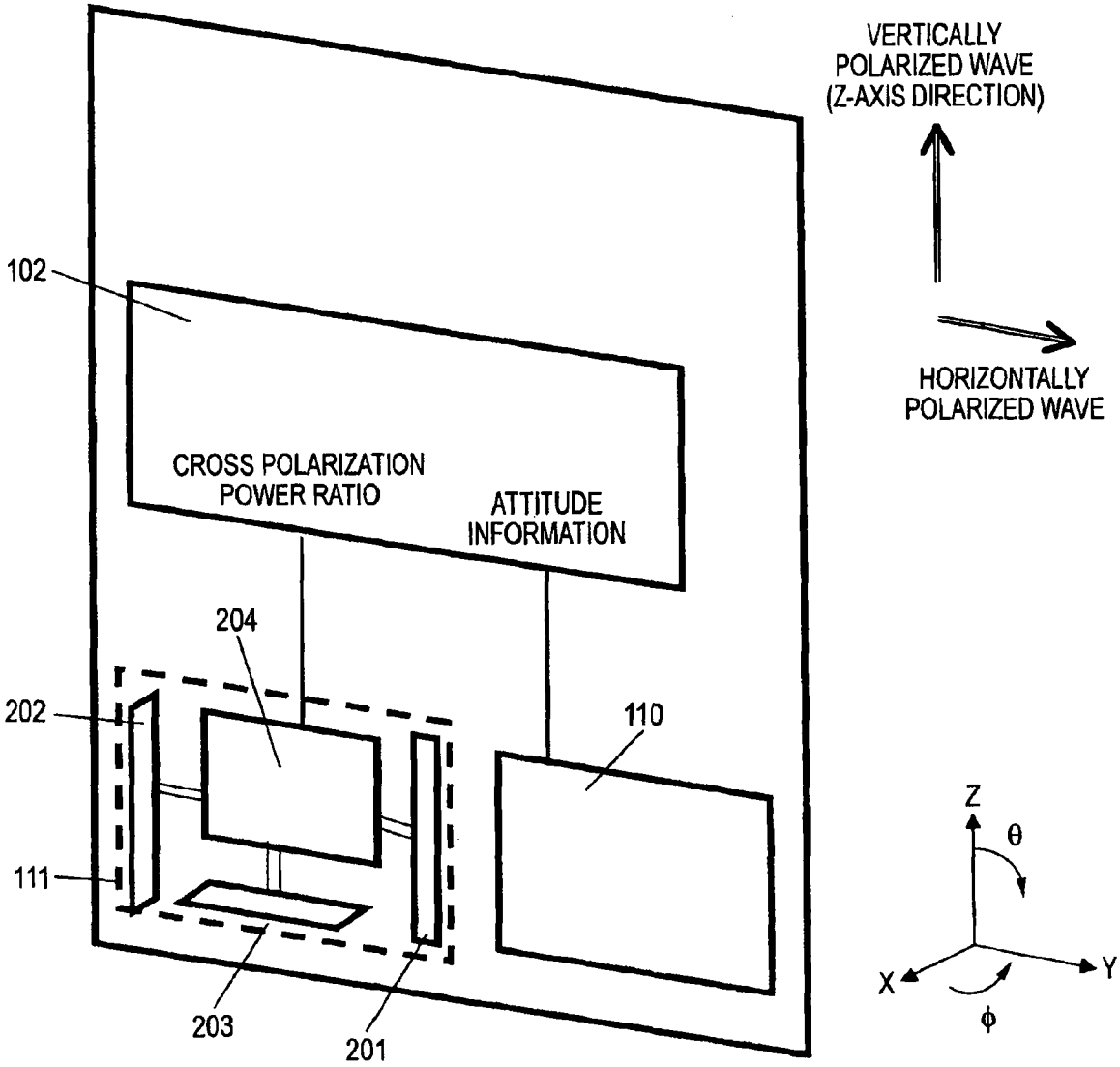
[FIG. 7] It is a view showing an example configuration of a cross polarization power ratio sensor 111 in the first embodiment of the present invention.

FIG. 7 is a view showing an example configuration of the cross polarization power ratio sensor 111. A micro-loop antenna 201 has a loop whose axial direction corresponds to the X-axis direction. A micro-loop antenna 202 has a loop whose axial direction corresponds to the Y-axis direction. A micro-loop antenna 203 has a loop whose axial direction corresponds to the Z-axis direction.

The signal processing section 204 is connected to the micro-loop antennas 201, 202, and 203, and measures the signal intensity of an incoming radio wave received by the micro-loop antennas 201, 202, and 203. The signal processing section 204 computes a cross polarization power ratio that is a ratio of vertical polarization power to horizontal polarization power, and outputs information about the ratio of cross polarization to the transceiver circuit 102. The transceiver circuit 102 may also process operations between measurement of signal intensity and computation of the ratio of cross polarization power.

The attitude sensor 110 detects the inclination of the antenna device of the present invention and assigns any of the micro-loop antennas 201, 202, and 203 to a vertical polarization measurement antenna and a horizontal polarization measurement antenna, in accordance with the inclination; and computes a ratio of cross polarization power from an intensity ratio between signals output from the respective antennas. For example, when the ground is parallel to the X-Y plane, a higher one of levels of signal intensity acquired by the micro-loop antennas 201 and 202 is taken as vertical polarization power, and a level of signal intensity acquired by the micro-loop antenna 203 is taken as horizontal polarization power, whereby a ratio of cross polarization power is computed.

Operation of the antenna configured as mentioned above is now described.

A transmission signal output from the transceiver circuit 102 is subjected to power division by the distributor 103, to thus be split into two signals. One of the thus-split two signals is converted by the phase shifter 104*a*, to thus assume a predetermined phase. The signal is further subjected to impedance conversion by the matching circuit 105 and output to the loop antenna 108. The remaining one of the thus-split two signals is converted by the phase shifter 104*b*, to thus assume a predetermined phase. The signal is further subjected to impedance conversion by the matching circuit 106 and output to the loop antenna 107. The loop antennas 107 and 108 are subjected to phase difference feeding in accordance with a phase shift level control signal output from the transceiver circuit 102.

Emission of a radio wave from the antenna device configured as mentioned above is now described.

Figure 8:
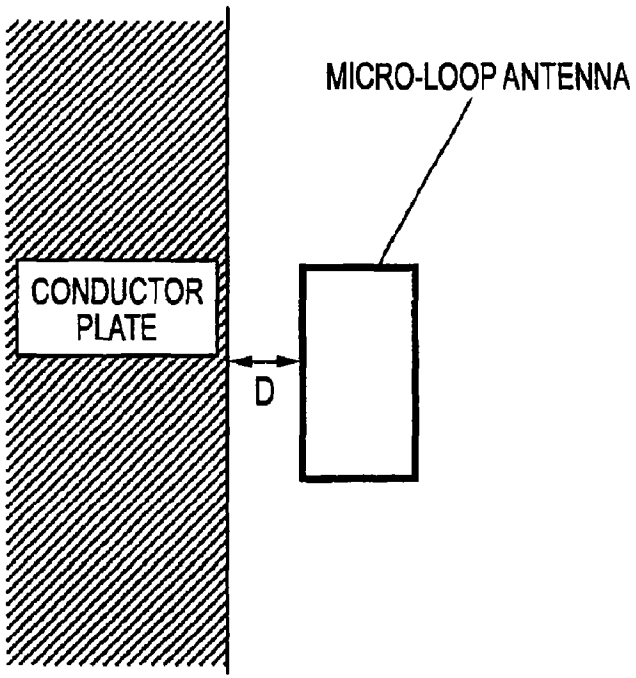
[FIG. 8] FIG. 8(*a*) is a view showing a positional relationship between a conductor plate and a micro-loop antenna in a first embodiment of the present invention, and FIG. 8(*b*) is a view showing a relationship between a distance from the micro-loop antenna to the conductor plate and a gain of another micro-loop antenna located in a direction opposite to the conductor plate in the first embodiment of the present invention.
Figure 8:
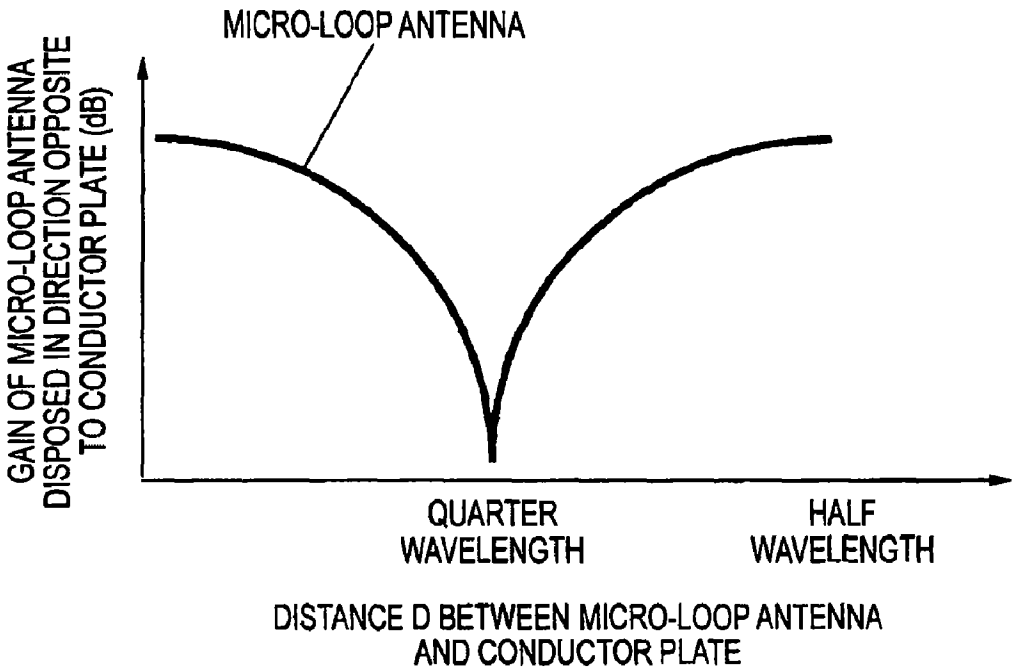

FIG. 8(*a*) is a view showing a positional relationship between a conductor plate and a micro-loop antenna. FIG. 8(*b*) is a view showing a relationship between a distance from the micro-loop antenna to the conductor plate and a gain of another micro-loop antenna located in a direction opposite to the conductor plate.

The micro-loop antenna operates as a magnetic current antenna that uses a magnetic current as a source of emission. Therefore, when the loop plane is perpendicular to the conductor surface and when a distance from the micro-loop antenna to the conductor plate is sufficiently shorter than a wavelength, a gain is increased.

When the distance from the micro-loop antenna to the conductor plate is an odd multiple of a quarter wavelength, the gain significantly decreases. When the distance from the micro-loop antenna to the conductor plate is an even multiple of the quarter wavelength, the gain becomes large.

Figure 9:
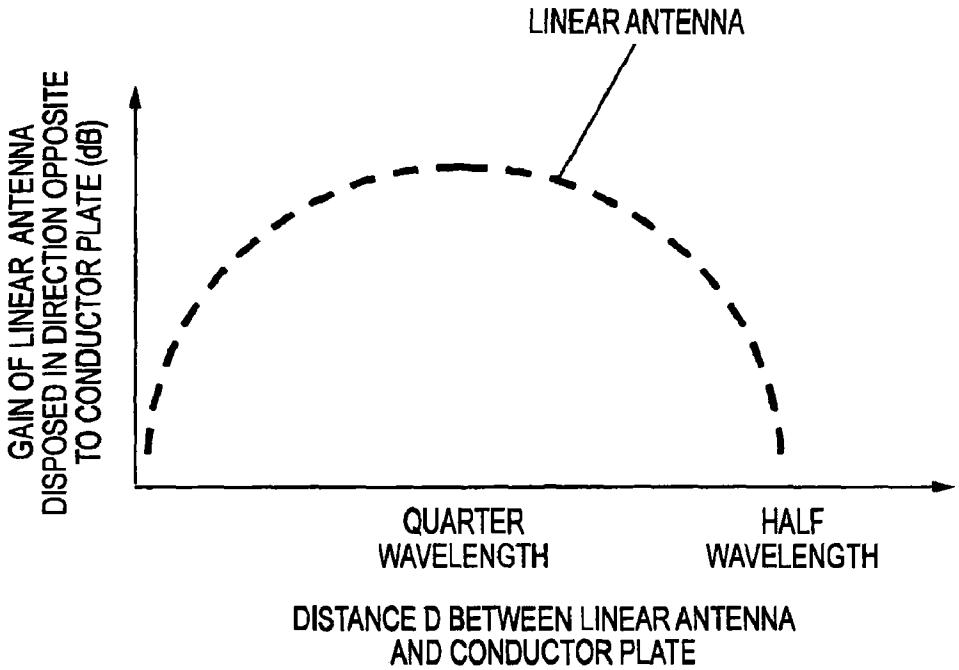
[FIG. 9] FIG. 9(*a*) is a view showing a positional relationship between a conductor plate and a linear antenna in the first embodiment of the present invention, and FIG. 9(*b*) is a view showing a relationship between a distance from the linear antenna to the conductor plate and a gain of another linear antenna located in a direction opposite to the conductor plate in the first embodiment of the present invention.
Figure 9:
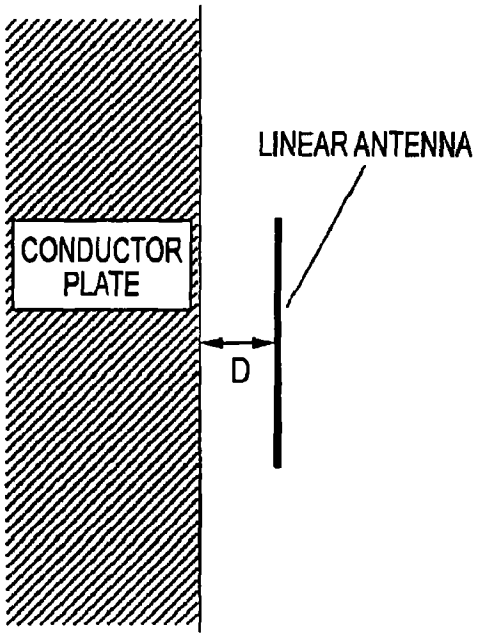

FIG. 9(*a*) is a view showing a positional relationship between a conductor plate and a linear antenna. FIG. 9(*b*) is a view showing a relationship between a distance from the linear antenna to the conductor plate and a gain of another linear antenna located in a direction opposite to the conductor plate.

The linear antenna operates as an electric current antenna that uses an electric current as a source of emission. Therefore, when the linear antenna is parallel to the conductor surface and when the distance from the linear antenna to the conductor plate is sufficiently shorter than a wavelength, a gain significantly decreases.

When the distance from the linear antenna to the conductor plate is an odd multiple of a quarter wavelength, the gain becomes large. When the distance from the linear antenna to the conductor plate is an even multiple of the quarter wavelength, a gain significantly decreases.

From FIGS. 8 and 9, the essential requirement for diminishing a gain change due to influence of a conductor, such as a human body, on the antenna device is seen that an antenna device should have both an electric current antenna element and a magnetic current antenna element.

In the antenna device of the present invention, the loop antennas 107 and 108 operate as magnetic current antennas, and the ground plate 101 operates as an electric current antenna. In relation a polarized wave to be emitted, provided that the ground is parallel to the X-Y plane in FIG. 1; that a polarized wave achieved in the Z-axis direction is taken as a vertical polarized wave; and that a polarized wave perpendicular to the vertically polarized wave is taken as a horizontally polarized wave, an electric current flows through the loop antennas 107 and 108 in a looped pattern along the X-Y plane, whereupon the horizontally polarized wave is emitted. The loop antenna elements are provided on the ground plate 101 in its Z-axis direction, and the longitudinal direction of the ground plate corresponds to the Z-axis direction. Therefore, an electric current flows in the Z-axis direction, and the vertically-polarized wave is emitted. The horizontally-polarized wave is emitted as the magnetic current antenna component, and the vertically-polarized wave is emitted as the electric current antenna component.

Figure 10:
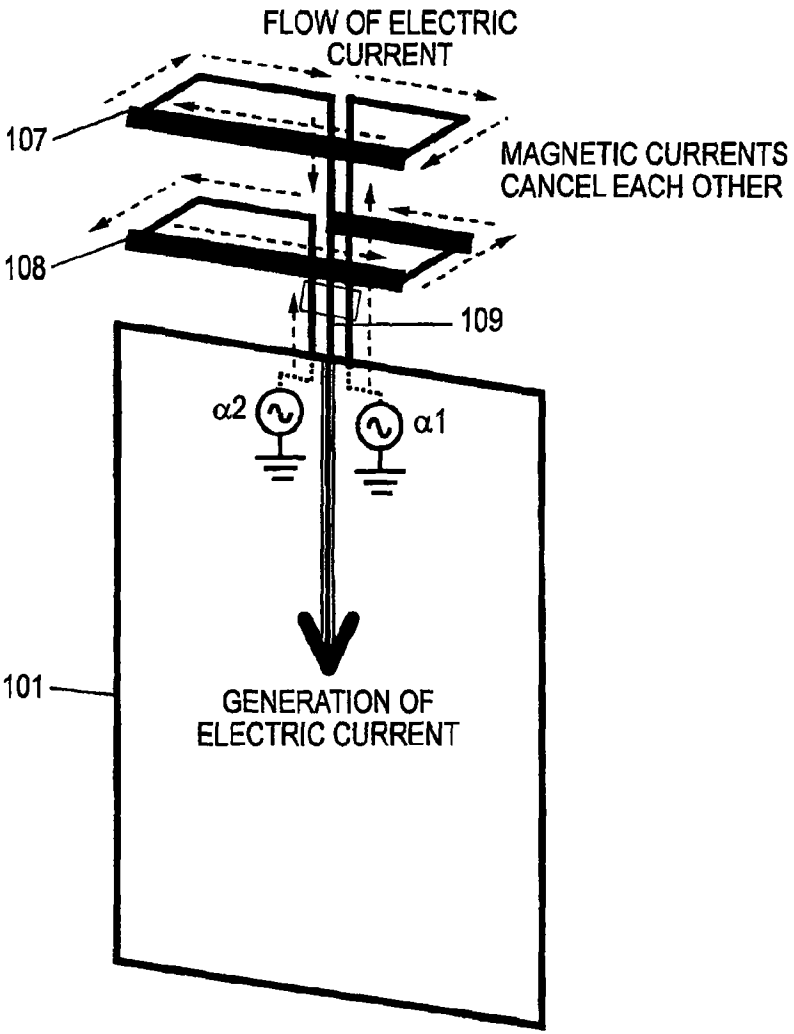
[FIG. 10] FIG. 10(*a*) is a view showing operation of the antenna device performed when a phase difference in power feed to the loop antennas 107 and 108 is 0° in the first embodiment of the present invention, and FIG. 10(*b*) is a view showing operation of the antenna device performed when the phase difference of power feed to the loop antennas 107 and 108 is 180° in the first embodiment of the present invention.
Figure 10:
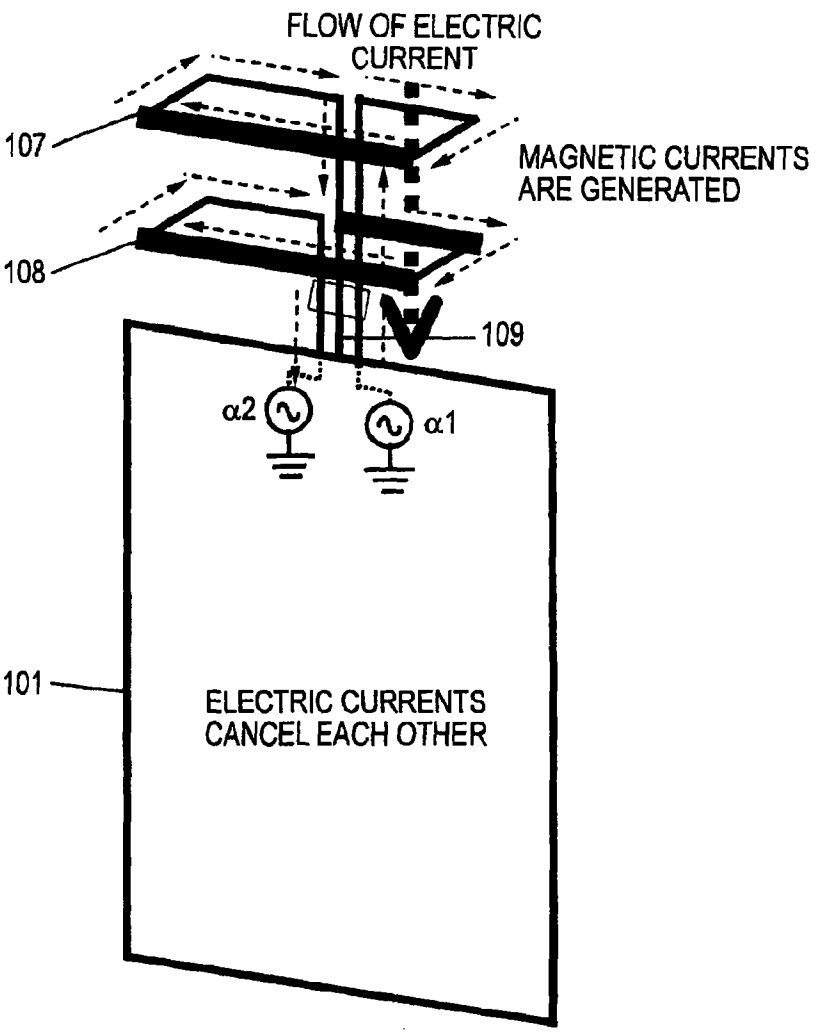

FIG. 10(*a*) is a view showing operation of the antenna device performed when a phase difference in power feed to the loop antennas 107 and 108 is 0°. A feed phase of the loop antenna 107 is assumed to be al; a feed phase of the loop antenna 108 is assumed to be $\alpha 2$; and a feed phase difference is assumed to be $\alpha 1$-$\alpha 2$. When the phase difference is 0°, electric currents flowing into the loop antennas 107 and 108 flow in opposite directions. Magnetic currents originating from the loop antennas 107 and 108 hence cancel each other. Both of the electric current flowing from the loop antennas 107 and 108 into the ground line 109 are oriented in the same direction; hence, an electric current flows into the ground plate 101.

FIG. 10(*b*) is a view showing operation of the antenna device performed when the phase difference of power feed to the loop antennas 107 and 108 is 180°. When the phase difference is 180°, the electric currents flowing into the loop antennas 107 and 108 are oriented in the same direction, and hence a magnetic current develops in the loop antennas 107 and 108. The electric currents flowing from the loop antennas 107 and 108 into the ground line 109 flow in opposite directions, whereby the electric currents cancel each other.

Figure 11:
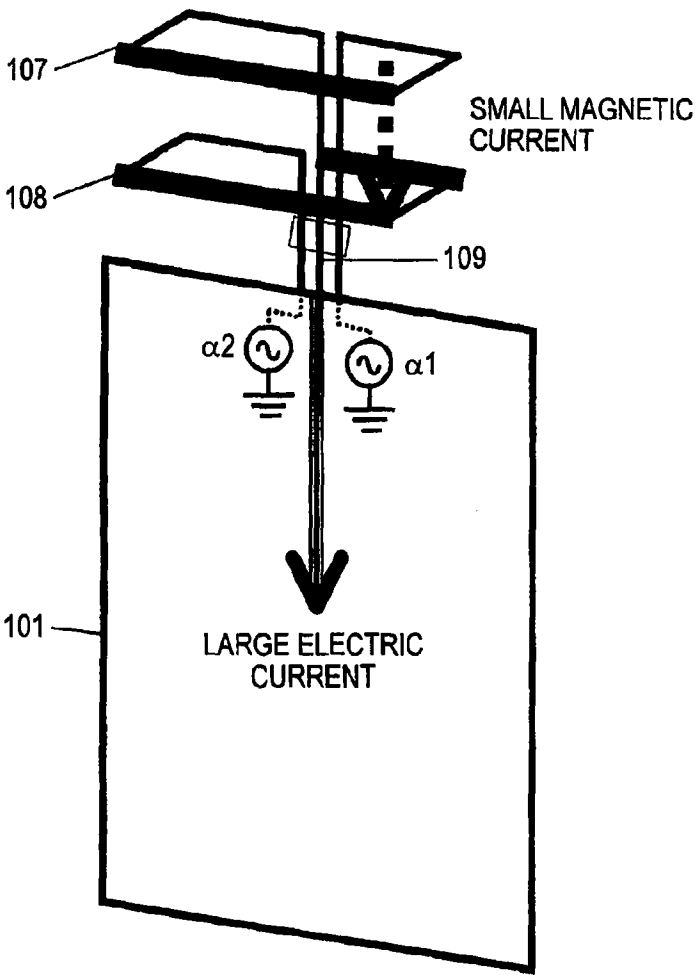
[FIG. 11] FIG. 11(*a*) is a view showing operation of the antenna device performed when a phase difference in power feed to the loop antennas 107 and 108 is 60° in the first embodiment of the present invention, and FIG. 11(*b*) is a view showing operation of the antenna device performed when a phase difference in power feed to the loop antennas 107 and 108 is 120° in the first embodiment of the present invention.
Figure 11:
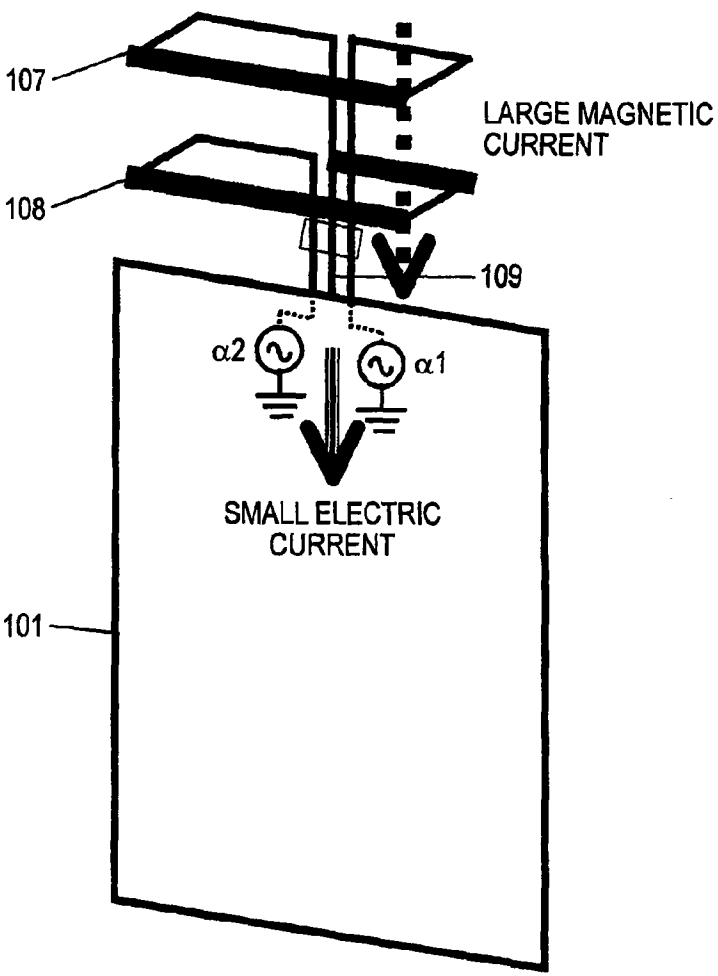

FIG. 11(*a*) is a view showing operation of the antenna device performed when a phase difference in power feed to the loop antennas 107 and 108 is 60°. FIG. 11(*b*) is a view showing operation of the antenna device performed when a phase difference in power feed to the loop antennas 107 and 108 is 120°.

As the phase difference in feeding power becomes close to 0°, a magnetic current becomes weaker, and the electric current becomes more intensified. Meanwhile, as a phase difference in power feed becomes close to 180°, a magnetic current becomes stronger, and the electric current becomes less intensified.

It is seen from FIGS. 10 and 11 that distribution of an electric current and a magnetic current can be controlled by changing a difference in feed phase.

A characteristic of the antenna device of the present invention is now described on the basis of a computation result.

Figure 12:
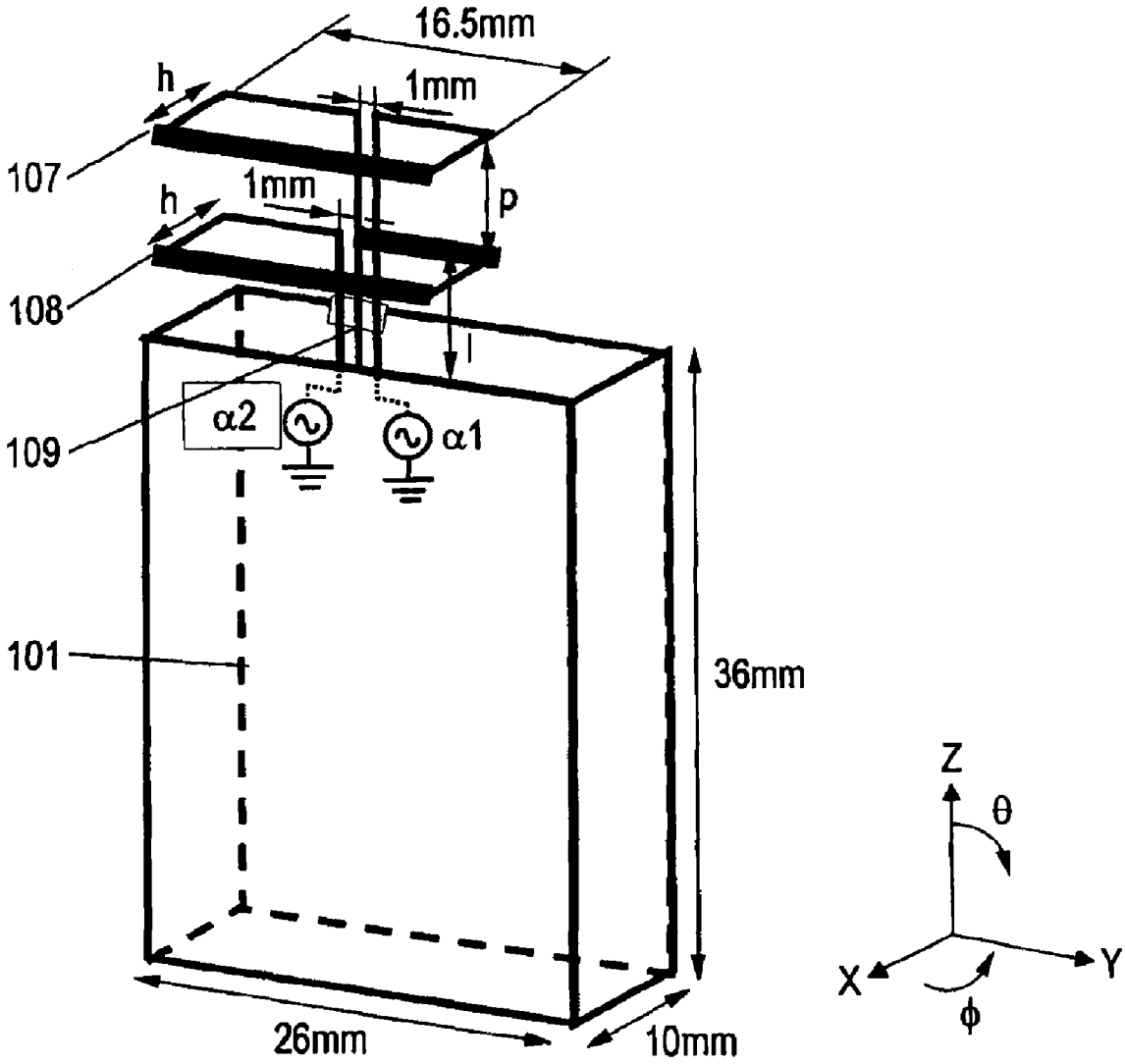
[FIG. 12] It is a view showing dimensions of the antenna device acquired by computation in the first embodiment of the present invention.

FIG. 12 is a view showing dimensions of the antenna device acquired by computation. Computation is performed on the assumption that a frequency is 426 MHz; that a line diameter of the loop antennas 107 and 108 is 0.4 mm; that a distance between the loops is "p"; that the length of the loop achieved in the X-axis direction is "h"; and the distance between the loop antenna 108 and the ground plate 101 is "l."

Figure 13:
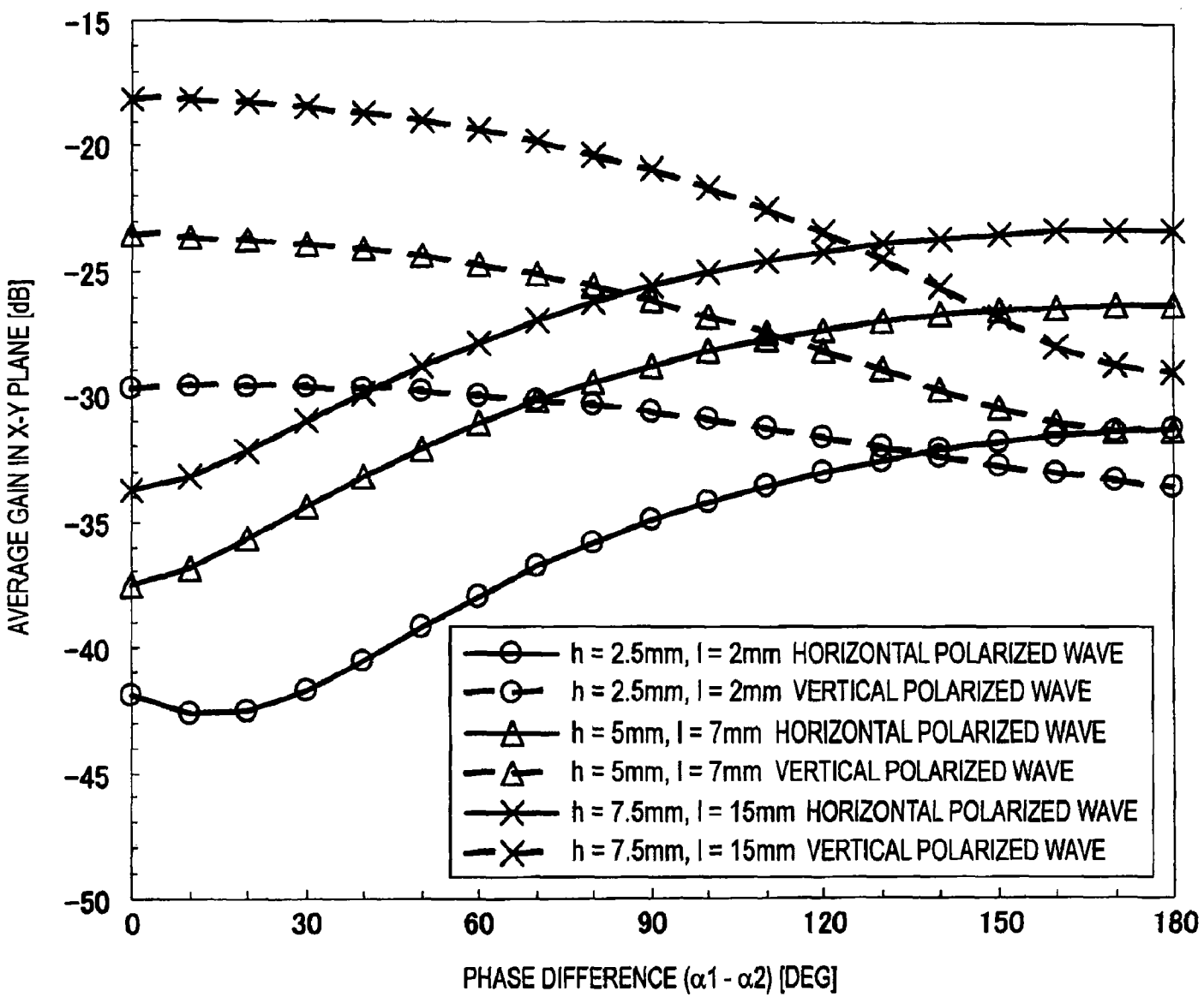
[FIG. 13] It is a view showing a relationship between a feed phase difference in the loop antennas 107 and 108 and an average gain of the X-Y plane of the antenna device in the first embodiment of the present invention.

FIG. 13 is a view showing a relationship between a feed phase difference in the loop antennas 107 and 108 and an average gain of the X-Y plane of the antenna device. Values are computed on condition that the distance "p" between the loops is 7.5 mm.

It is possible to continually, significantly change distribution of a radio wave originated from the vertically and horizontally polarized components; in other words, the electric current and magnetic current antenna components, by feed phase difference.

Figure 14:
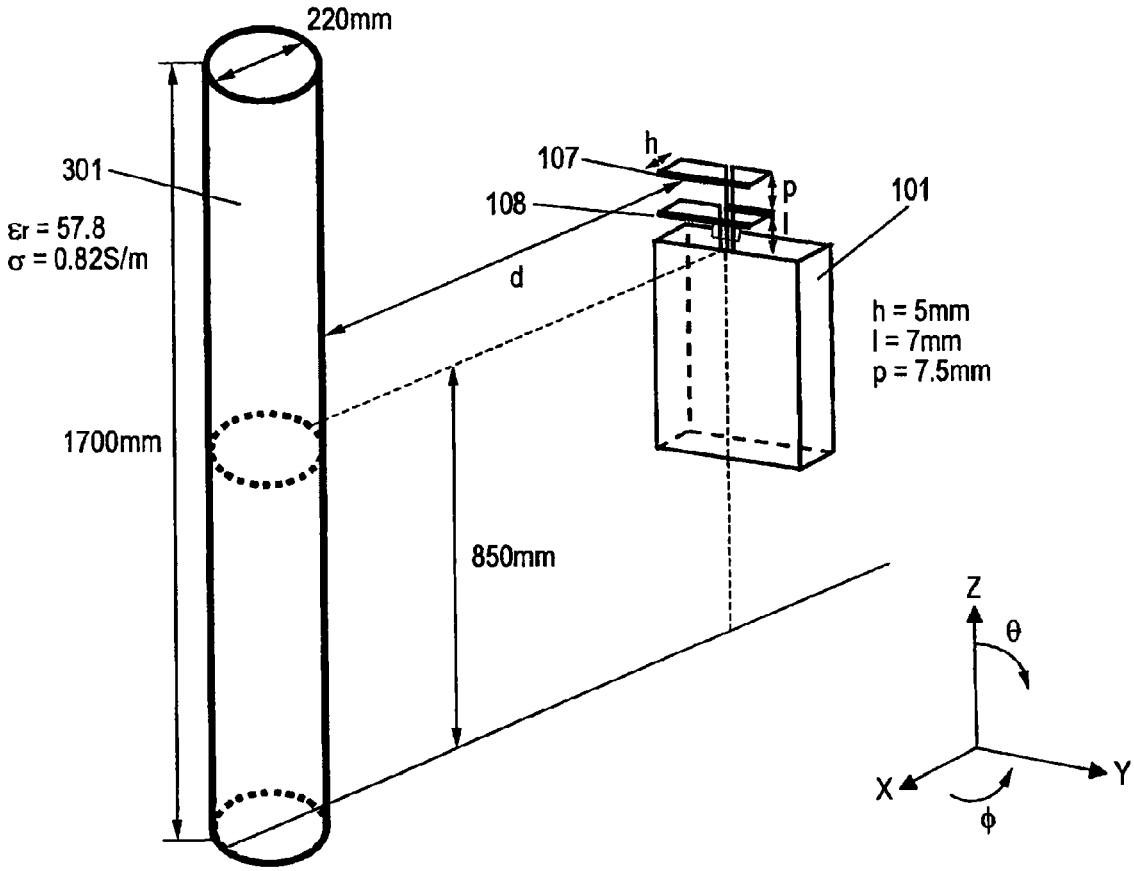
[FIG. 14] It is a view showing an analysis model of influence on a human body and dimensions of the analysis model for a case where the loop planes of the loop antennas 107 and 108 are horizontal to the X-Y plane in the first embodiment of the present invention.

FIG. 14 is a view showing an analysis model of influence on a human body and dimensions of the analysis model for a case where the loop planes of the loop antennas 107 and 108 are horizontal to the X-Y plane. In FIG. 14, a human body model 301 is one that is acquired by modeling a human body standing upright in the form of a columnar shape assuming a diameter of 220 mm and a height of 1700 mm. The human body model 301 has a dielectric constant of 57.8 and a conductivity of 0.82 S/m. Influence of the human body on the antenna device of the present invention is calculated by changing the distance "d" between the antenna device of the present invention and the human body model 301.

Figure 15:
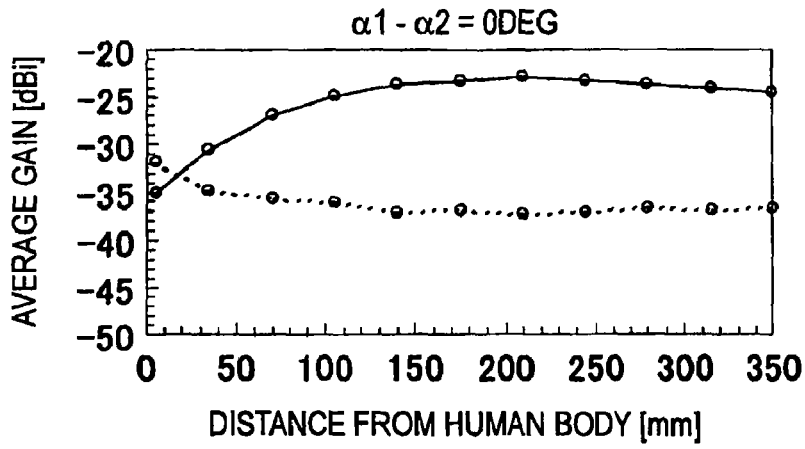
[FIG. 15] FIG. 15(*a*) is a view showing a change in average gain of the X-Y plane with respect to the distance between the antenna device and a human body model 301 arising when the loop planes of the loop antennas 107 and 108 are horizontal to the X-Y plane with a feed phase difference of 0° in the first embodiment of the present invention.
Figure 15:
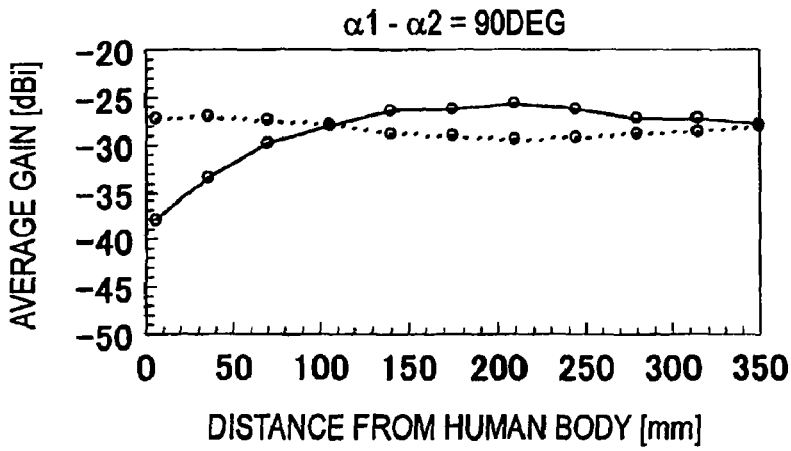
Figure 15:
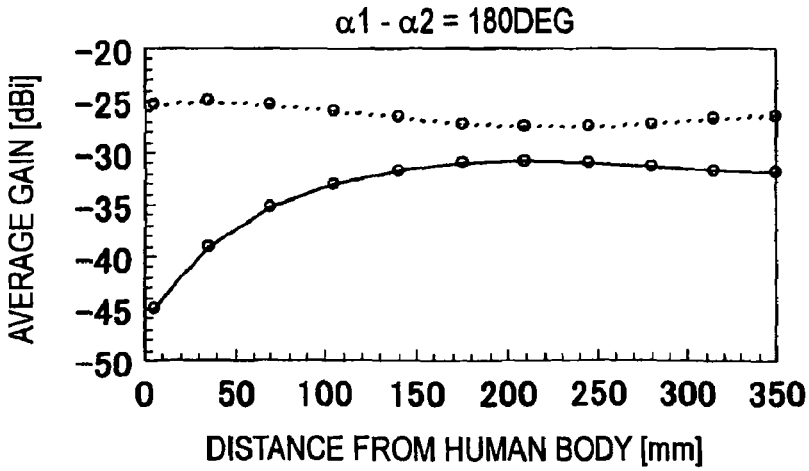

FIG. 15(*a*) is a view showing a change in average gain of the X-Y plane with respect to the distance between the antenna device and the human body model 301 arising when the loop planes of the loop antennas 107 and 108 are horizontal to the X-Y plane with a feed phase difference of 0°. FIG. 15(*b*) is a view showing a change in average gain of the X-Y plane with respect to the distance between the antenna device and the human body model 301 arising when the loop planes of the loop antennas 107 and 108 are horizontal to the X-Y plane with a feed phase difference of 90°. FIG. 15(*c*) is a view showing a change in average gain of the X-Y plane with respect to the distance between the antenna device and the human body model 301 arising when the loop planes of the loop antennas 107 and 108 are horizontal to the X-Y plane with a feed phase difference of 180°.

It is seen that a gain characteristic dependent on the distance between the antenna device and the human body can be controlled by a feed phase difference. In order to compute an effective gain in an actual propagation environment, a mean effective gain (MEG) is computed for each cross polarization power ratio (XPR) when the distance between the antenna device and the human body is changed.

The cross polarization power ratio XPR is a ratio of vertical polarization power to horizontal polarization power and is expressed by the following equation.

$$XPR = \frac{\text{VERTICAL POLARIZATION POWER}}{\text{HORIZONTAL POLARIZATION POWER}} \quad \text{[Expression 1]}$$

Provided that an incoming wave concentrates on substantially an interior of the horizontal plane and is uniformly distributed and that a mean value of a vertically polarized component and a mean value of a horizontally polarized component of the power gain directivity of the antenna achieved within the X-Y plane are taken as Gθave and Gϕave, the mean effective gain MEG can also be expressed by a simplified expression, such as that provided blow.

$$MEG = \frac{XPR}{1+XPR}G_{\theta ave} + \frac{1}{1+XPR}G_{\varphi ave} \quad \text{[Expression 2]}$$

Figure 16:
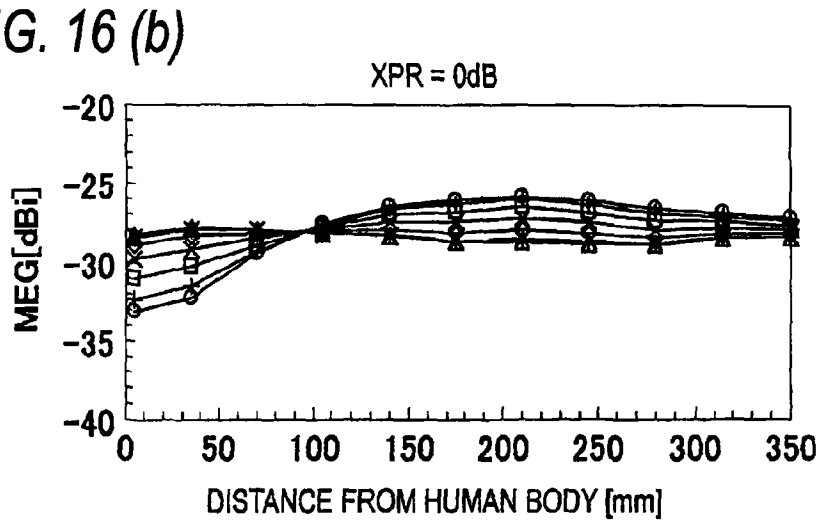
[FIG. 16] FIG. 16(*a*) is a view showing a change in MEG with respect to the distance between the antenna device and the human body arising when the loop planes of the loop antennas 107 and 108 are horizontal to the X-Y plane with XPR=6 dB in the first embodiment of the present invention.
Figure 16:
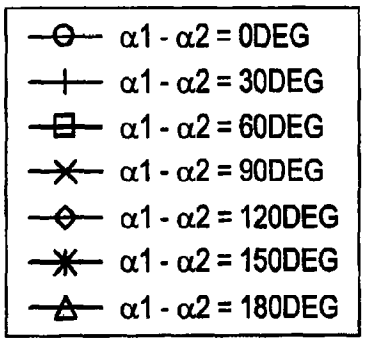
Figure 16:
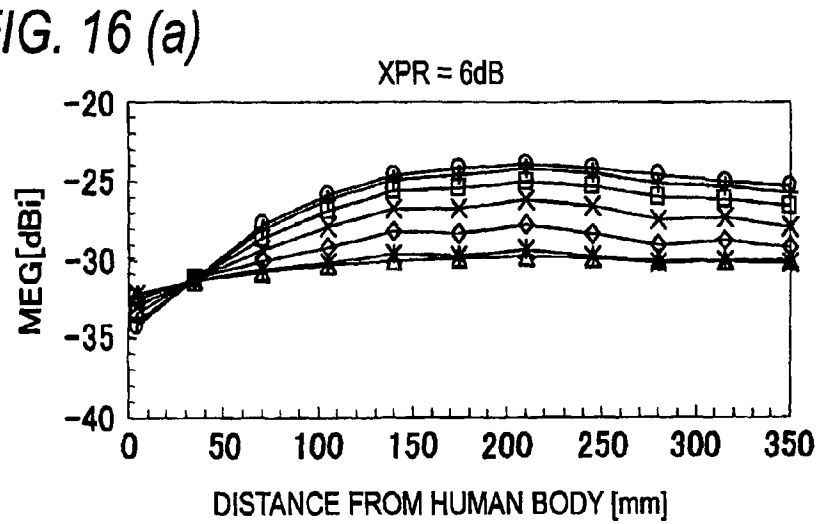
Figure 16:
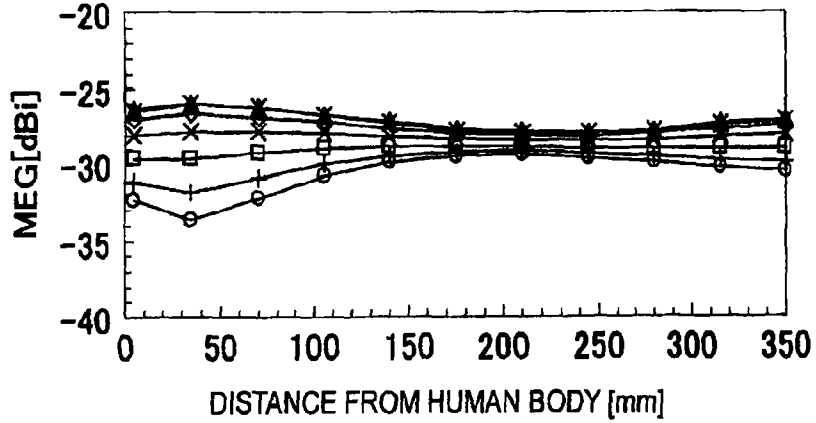

FIG. 16(*a*) is a view showing a change in MEG with respect to the distance between the antenna device and the human body arising when the loop planes of the loop antennas 107 and 108 are horizontal to the X-Y plane with XPR=6 dB. FIG. 16(*b*) is a view showing a change in MEG with respect to the distance between the antenna device and the human body arising when the loop planes of the loop antennas 107 and 108 are horizontal to the X-Y plane with XPR=0 dB. FIG. 16(*c*) is a view showing a change in MEG with respect to the distance between the antenna device and the human body arising when the loop planes of the loop antennas 107 and 108 are horizontal to the X-Y plane with XPR=−6 dB.

It is seen from FIG. 16 that there is phase differences that make an MEG constant with respect to respective specific XPRs.

Figure 17:
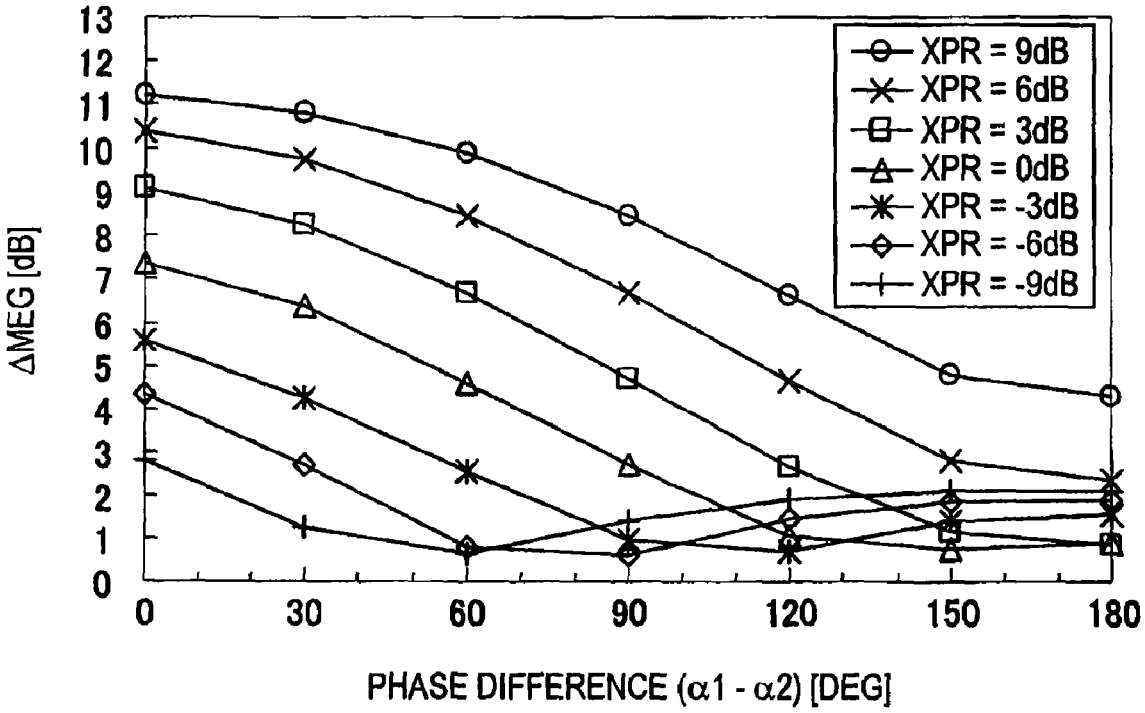
[FIG. 17] It is a view showing variations in ΔMEG caused by feed phase differences when the loop planes of the loop antennas 107 and 108 are horizontal to the X-Y plane in the first embodiment of the present invention.

A margin of MEG changes arising within a range of distances of 5 mm to 210 mm from the human body is assumed to be ΔMEG, which is taken as an index for evaluating gain variations caused by the human body. FIG. 17 is a view showing variations in ΔMEG caused by feed phase differences when the loop planes of the loop antennas 107 and 108 are horizontal to the X-Y plane. It is seen that there are phase differences which minimize the ΔMEGs with respect to the respective XPRs determined by a propagation environment, or the like.

The above is descriptions about the cases where the loop planes of the loop antennas 107 and 108 are horizontal to the X-Y plane. Likewise, FIGS. 18 to 21 show results of analysis of influence of a human body arising when the loop planes of the respective loop antennas 107 and 108 are perpendicular to the X-Y plane.

Figure 18:
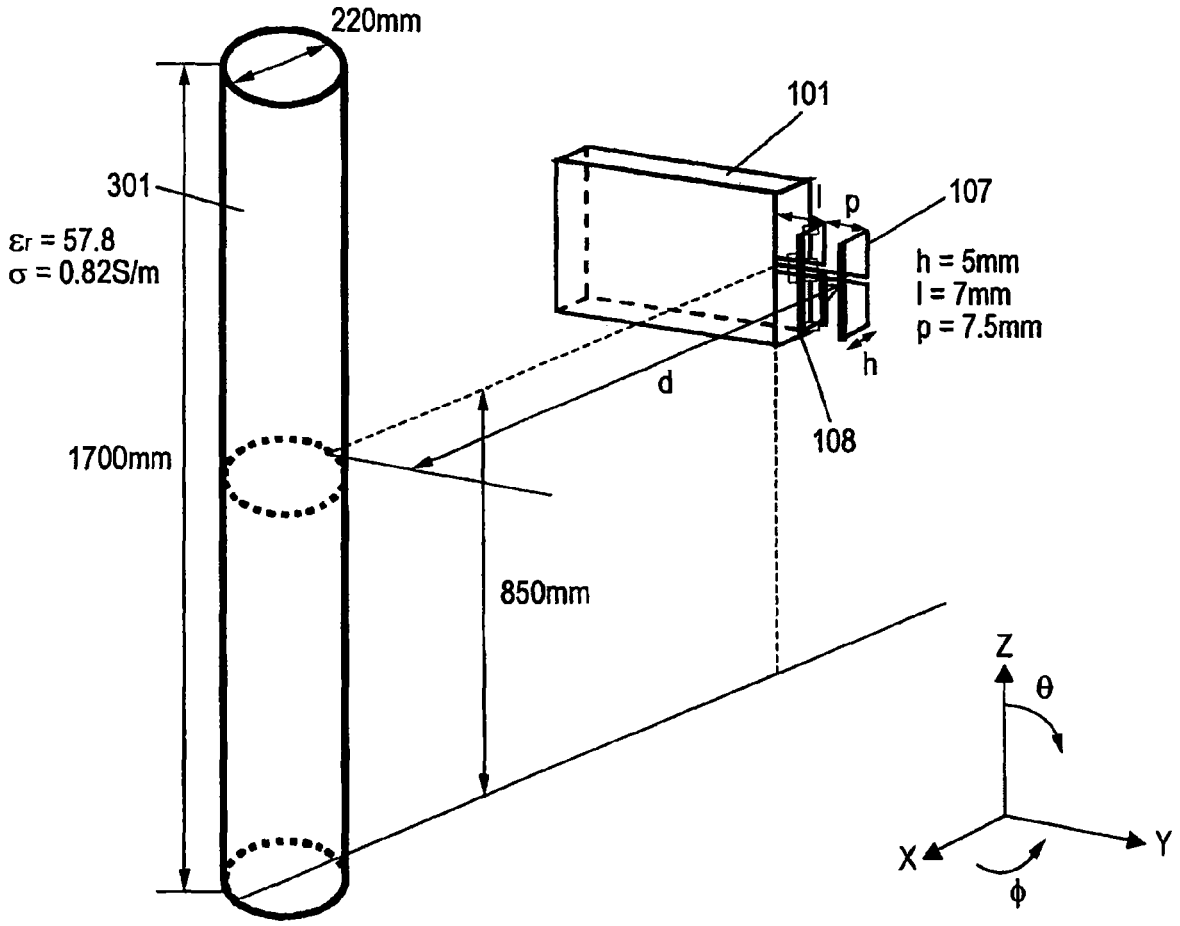
[FIG. 18] It is a view showing an analysis model of influence on a human body and dimensions of the analysis model for a case where the loop planes of the loop antennas 107 and 108 are perpendicular to the X-Y plane in the first embodiment of the present invention.

FIG. 18 is a view showing an analysis model of influence on a human body and dimensions of the analysis model for a case where the loop planes of the loop antennas 107 and 108 are perpendicular to the X-Y plane.

Figure 19:
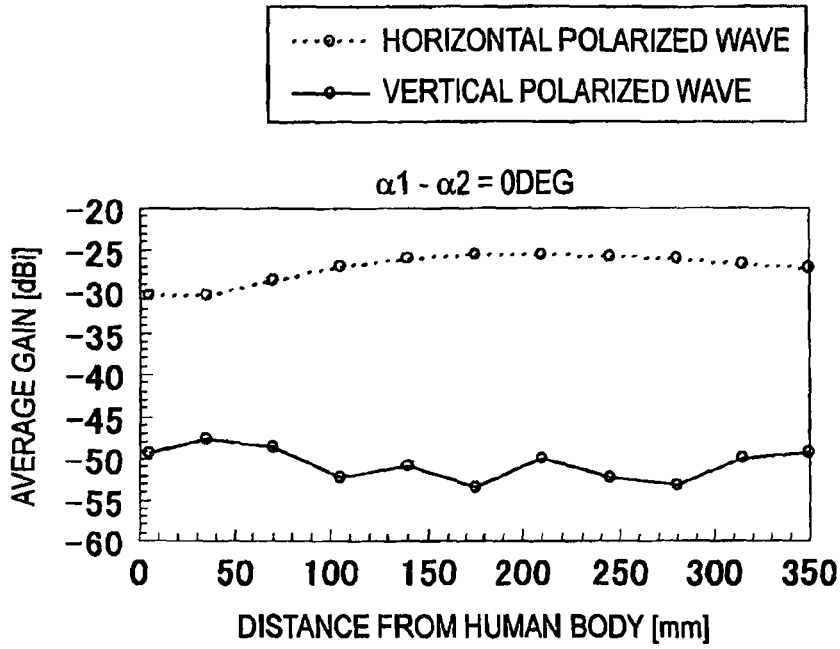
[FIG. 19] FIG. 19(*a*) is a view showing a change in average gain of the X-Y plane with respect to the distance between the antenna device and the human body model 301 arising when the loop planes of the loop antennas 107 and 108 are perpendicular to the X-Y plane with a feed phase difference of 0° in the first embodiment of the present invention.
Figure 19:
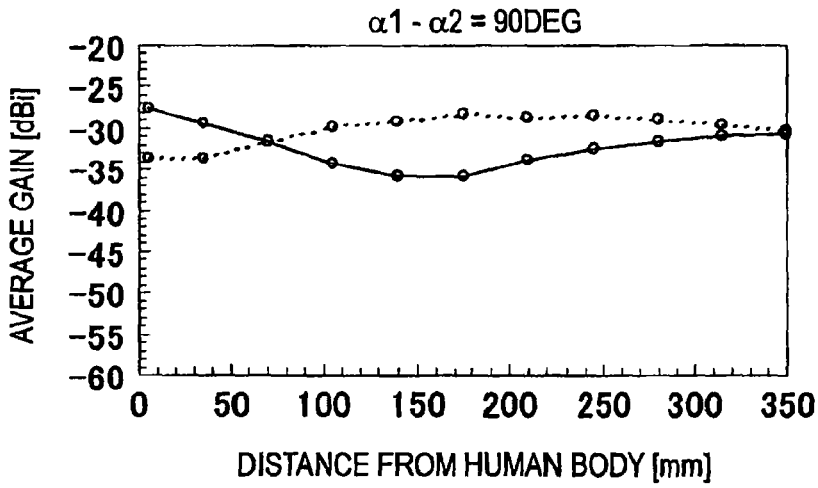
Figure 19:
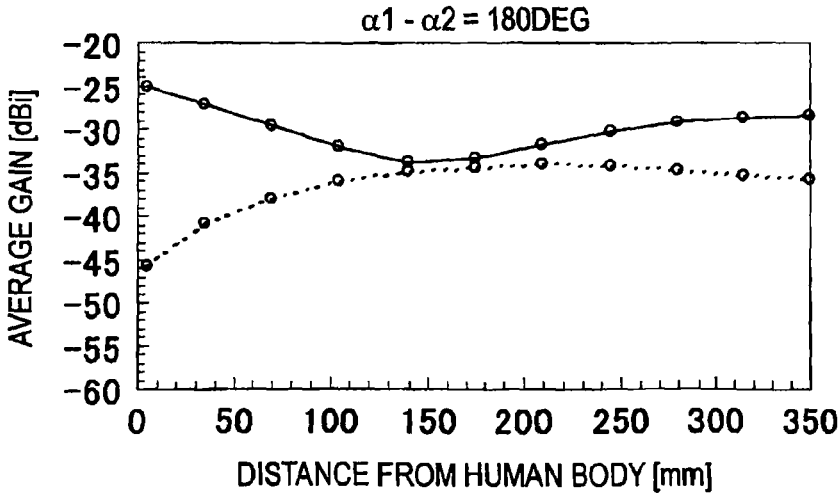

FIG. 19(*a*) is a view showing a change in average gain of the X-Y plane with respect to the distance between the antenna device and the human body model 301 arising when the loop planes of the loop antennas 107 and 108 are perpendicular to the X-Y plane with a feed phase difference of 0°. FIG. 19(*b*) is a view showing a change in average gain of the X-Y plane with respect to the distance between the antenna device and the human body model 301 arising when the loop planes of the loop antennas 107 and 108 are perpendicular to the X-Y plane with a feed phase difference of 90°. FIG. 19(*c*) is a view showing a change in average gain of the X-Y plane with respect to the distance between the antenna device and the human body model 301 arising when the loop planes of the loop antennas 107 and 108 are perpendicular to the X-Y plane with a feed phase difference of 180°.

Figure 20:
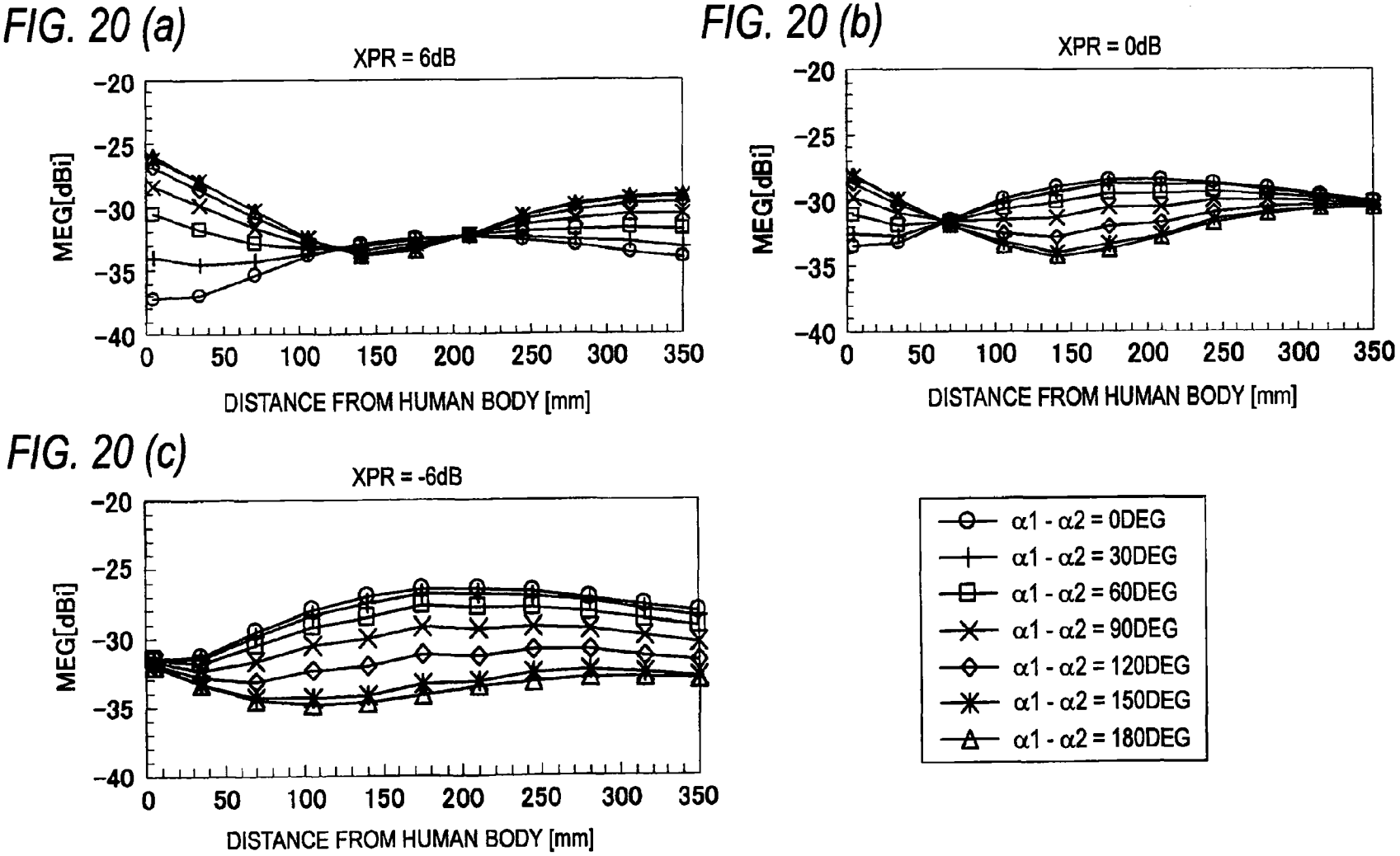
[FIG. 20] FIG. 20(*a*) is a view showing a change in MEG with respect to the distance between the antenna device and the human body arising when the loop planes of the loop antennas 107 and 108 are perpendicular to the X-Y plane with XPR=6 dB in the first embodiment of the present invention.

FIG. 20(*a*) is a view showing a change in MEG with respect to the distance between the antenna device and the human body arising when the loop planes of the loop antennas 107 and 108 are perpendicular to the X-Y plane with XPR=6 dB. FIG. 20(*b*) is a view showing a change in MEG with respect to the distance between the antenna device and the human body arising when the loop planes of the loop antennas 107 and 108 are perpendicular to the X-Y plane with XPR=0 dB. FIG. 20(*c*) is a view showing a change in MEG with respect to the distance between the antenna device and the human body arising when the loop planes of the loop antennas 107 and 108 are perpendicular to the X-Y plane with XPR=−6 dB.

Figure 21:
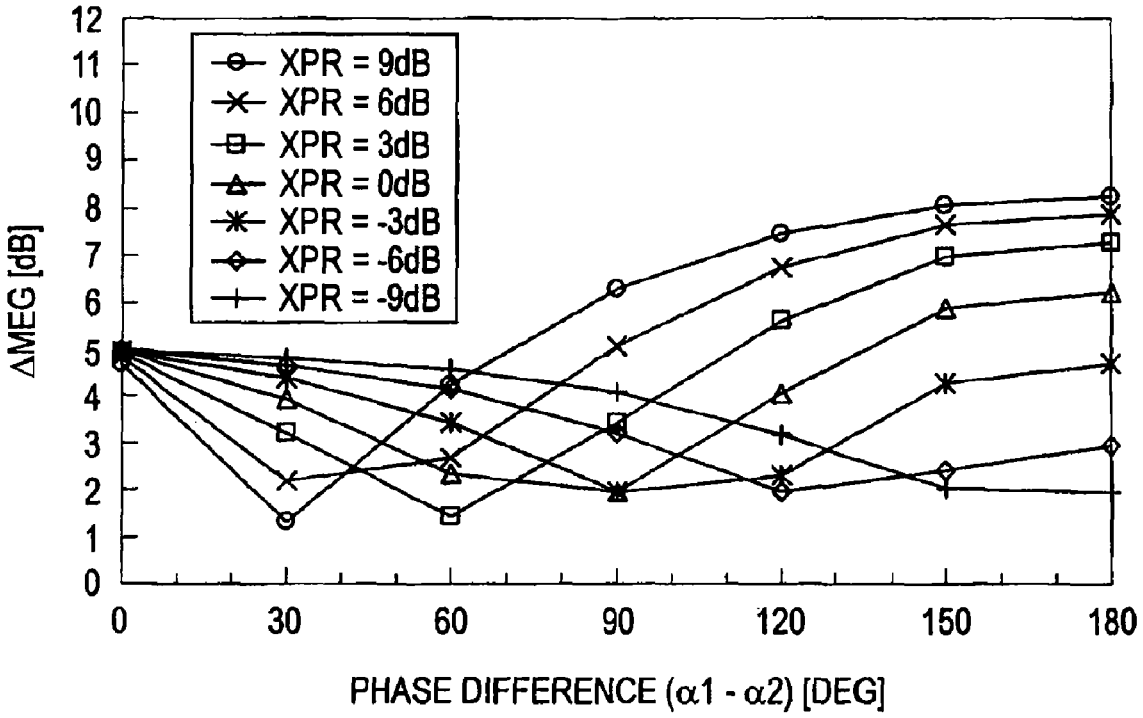
[FIG. 21] It is a view showing changes in ΔMEG caused by feed phase differences when the loop planes of the respective loop antennas 107 and 108 are perpendicular to the X-Y plane in the first embodiment of the present invention.

FIG. 21 is a view showing changes in ΔMEG caused by feed phase differences when the loop planes of the respective loop antennas 107 and 108 are perpendicular to the X-Y plane.

From the above, it is understood that a gain characteristic dependent on the distance between the antenna device and the human body can be controlled by a feed phase difference even when the loop planes of the respective loop antennas 107 and 108 are perpendicular to the X-Y plane in the same manner as when the loop planes of the respective loop antennas 107 and 108 are horizontal to the X-Y plane. It is seen that there is phase differences that make an MEG constant with respect to respective specific XPRs. It is seen that there are phase differences which minimize the ΔMEGs with respect to the respective XPRs determined by a propagation environment, or the like.

In order to change the feed phase difference without collapsing impedance matching between the loop antennas 107 and 108, an amount of mutual coupling between the loop antennas 107 and 108 must be made small.

Figure 22:
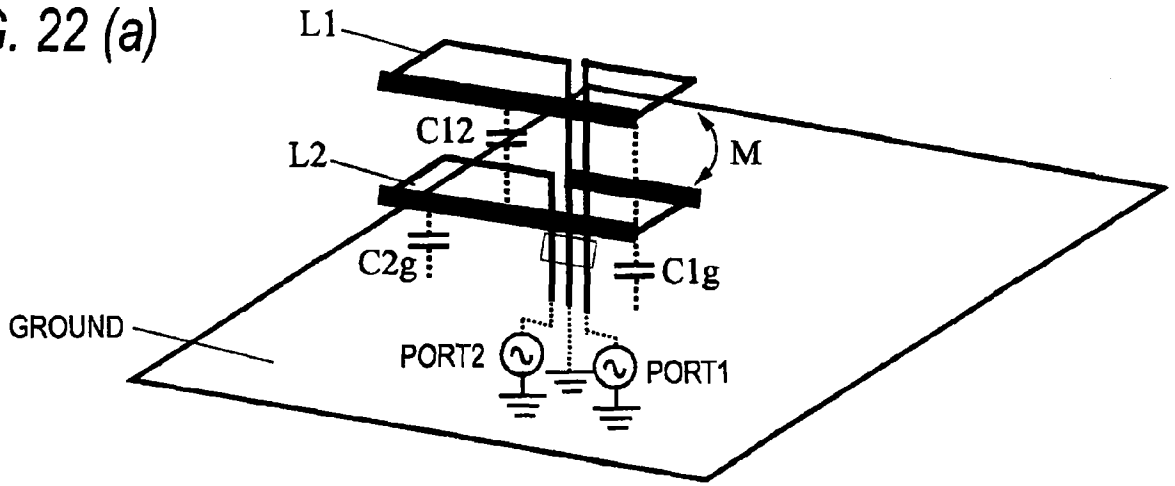
[FIG. 22] FIG. 22(*a*) is a view showing an equivalent circuit model of the antenna device of the first embodiment of the present invention.
Figure 22:
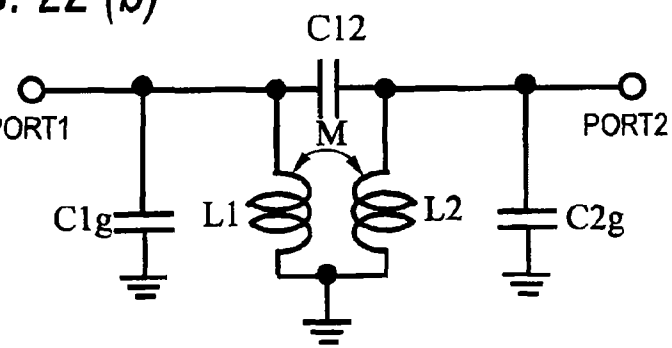
Figure 22:
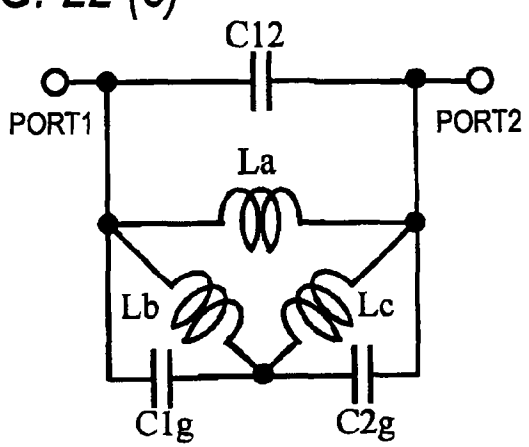

FIG. 22(*a*) is a view showing an equivalent circuit model of the antenna device of the present invention. FIG. 22(*b*) is a view showing an equivalent circuit of the antenna device of the present invention. FIG. 22(*c*) is a view showing an equivalent circuit of the antenna device of the present invention acquired after conversion.

In FIG. 22(*a*), inductances of the loop antennas 107 and 108 are assumed to be L1 and L2; a mutual inductance existing between the loop antennas 107 and 108 is assumed to be M; capacitance existing between the loop antennas 107 and 108 is assumed to be C12; and capacitance existing between the loop antenna 107 and the ground and capacitance existing between the loop antenna 108 and the ground are assumed to be C1*g* and C2*g*, an equivalent circuit of the antenna device of the present invention is illustrated as seen in FIG. 22(*b*). Further, FIG. 22(*c*) shows a result of conversion of the equivalent circuit shown in FIG. 22(*b*). Inductances La, Lb, and Lc correspond to a result of conversion of the inductance L1, a result of conversion of the inductance L2, and a result of conversion of the mutual inductance M, respectively. It is seen from FIG. 22(*c*) that the antenna device of the present invention can be deemed to be a combination of a plurality of parallel resonant circuits. Specifically, mutual coupling can be reduced by adjusting the size of the antenna device; namely, the distance between the loop antenna 107 and 108, areas of the loops of the loop antennas 107 and 108, and the distance between the loop antennas 107, 108 and the ground 101, so as to achieve parallel resonance.

Figure 23:
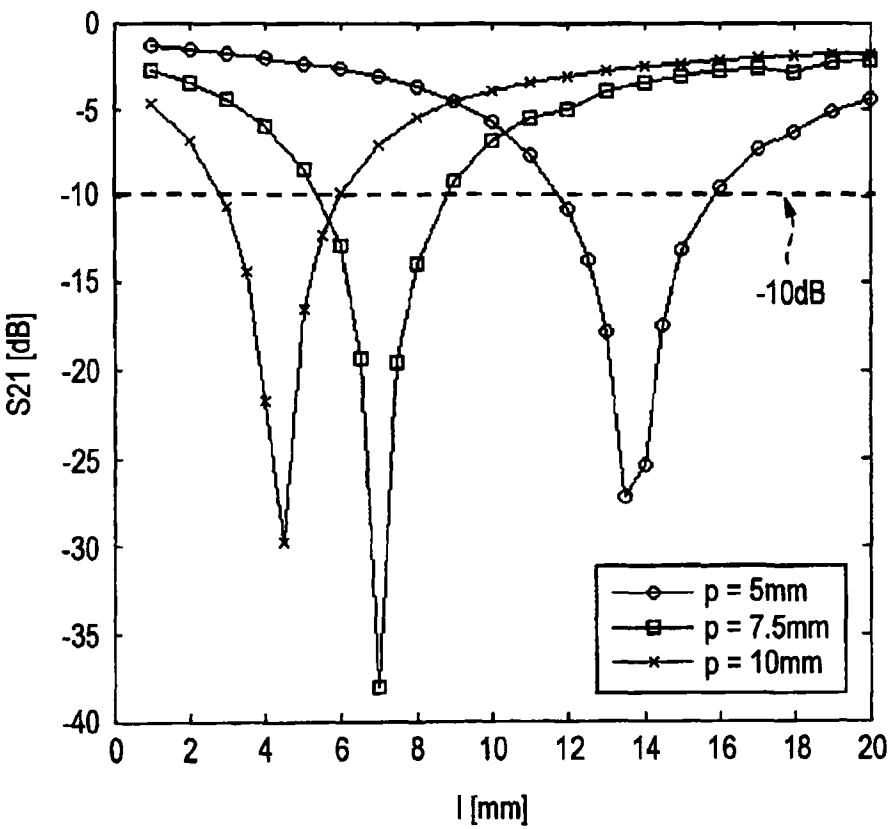
[FIG. 23] FIG. 23(*a*) is a view showing changes in S21 with respect to a distance "l" between the loop antenna 108 and a ground plate 101 arising when a length "h" of the loop in its X-axis direction is taken as 5 mm in the first embodiment of the present invention, and FIG. 23(*b*) is a view showing changes in S21 with respect to a distance "l" between the loop antenna 108 and the ground plate 101 arising when a distance "p" between the loops is taken as 7.5 mm in the first embodiment of the present invention.
Figure 23:
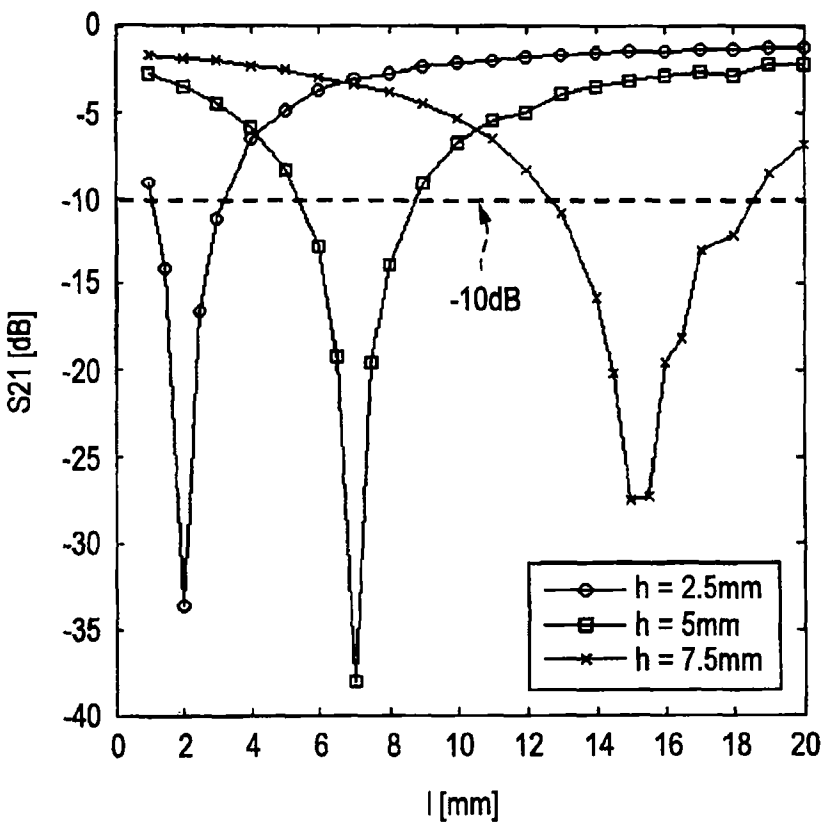

FIG. 23(*a*) is a view showing changes in S21 with respect to a distance "l" between the loop antenna 108 and the ground plate 101 arising when a length "h" of the loop in its X-axis direction is taken as 5 mm. FIG. 23(*b*) is a view showing changes in S21 with respect to a distance "l" between the loop antenna 108 and the ground plate 101 arising when a distance "p" between the loops is taken as 7.5 mm.

Reference numeral S21 of S parameters corresponds to a parameter representing a transmission coefficient of power, designating an amount of mutual coupling between the loop antennas 107 and 108. Although the smaller amount of mutual coupling is better, an amount of mutual coupling of −10 dB or less is desirable. Specifically, it is desirable that the loop antenna 107 and the loop antenna 108 be placed at a position where the amount of mutual coupling between the loop antenna 107 and the loop antenna 108 comes to −10 dB or less.

In FIG. 23(*a*), as a distance "p" between the loops becomes shorter, mutual inductance between the loops increases; hence, the value of I at which parallel resonance arises becomes greater. Mutual coupling is reduced by increasing the distance "l" to the ground with a reduction in the distance between the loops.

In FIG. 23(*b*), as areas of the loops increase, inductance of the loops and mutual inductance between the loops increase; hence, the value of I at which parallel resonance arises becomes greater. Mutual coupling is reduced by increasing the distance "l" to the ground with an increase in areas of the loops.

Figure 24:
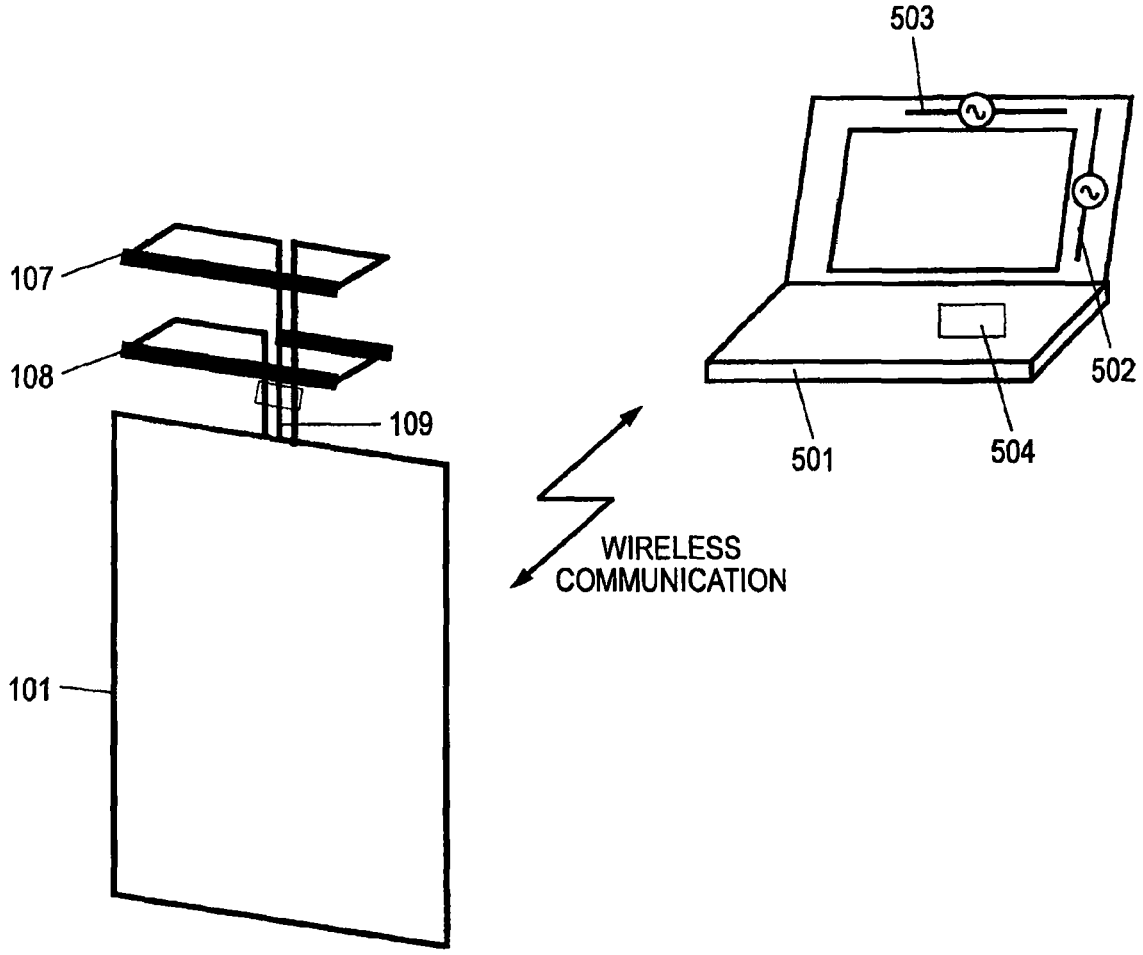
[FIG. 24] It is a view showing an example configuration of a system of the first embodiment of the present invention.

Procedures for controlling the phase of the antenna device of the present invention are now described. FIG. 24 is a view showing an example configuration of a wireless communication system including the antenna device of the present invention and a controlled apparatus 501.

The controlled apparatus 501 is one that is subjected to control of operation of a function lock and a warning buzzer depending on whether or not the antenna device of the present invention is in an authentication area (a radius of several meters from the authentication key). Specifically, when the antenna device is not in the authentication area, operation of the function lock or the warning buzzer is performed. On the contrary, when the antenna device is in the authentication area, operation of the function lock or the warning buzzer is not performed.

A vertical polarization antenna 502 is provided in the controlled apparatus 501 in order to conducts wireless communication with the antenna device and emits a vertically polarized wave component. A horizontal polarization antenna 503 is provided in the controlled apparatus 501 in order to conduct wireless communication with the antenna device and emits a horizontally polarized wave component.

An attitude sensor 504 is provided in the controlled apparatus 501 and detects an inclination of the controlled apparatus 501, thereby outputting inclination information to the antenna by the wireless communication. The attitude sensor 504 is specifically built from a sensor capable of detecting an inclination with respect to a reference plane (e.g., the ground), such as an acceleration sensor and an overturn sensor.

Figure 25:
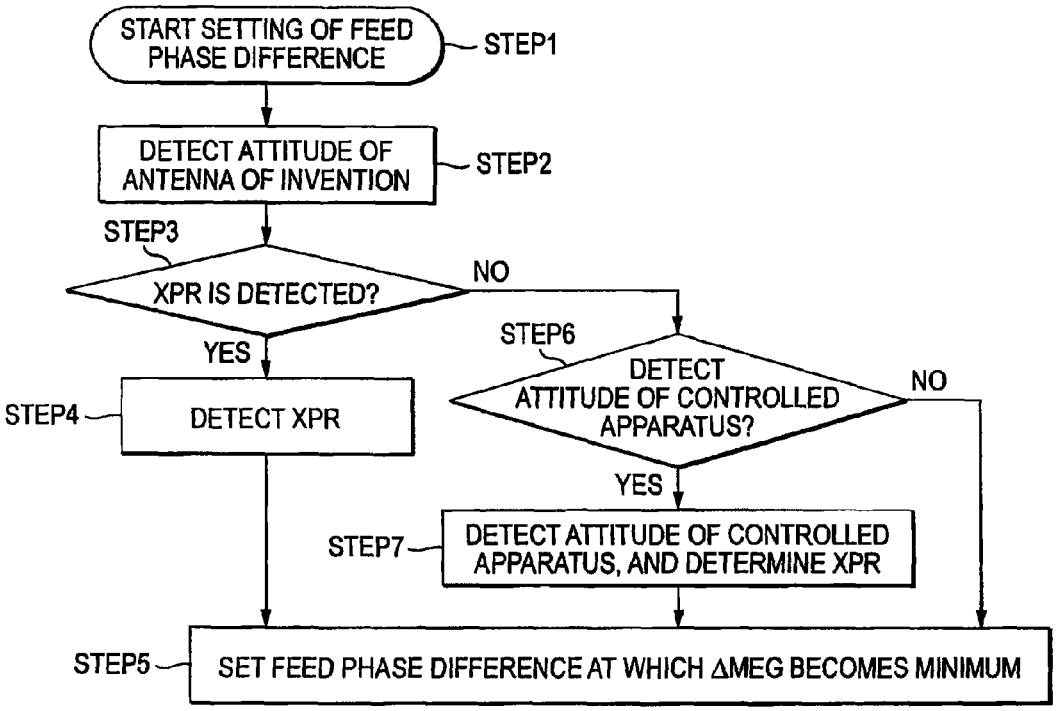
[FIG. 25] It is a view showing procedures for setting a feed phase difference in the antenna device of the first embodiment of the present invention.

FIG. 25 is a view showing procedures for setting a feed phase difference in the antenna device of the present invention. In step S1, the antenna device (the transceiver circuit 102) first starts setting a feed phase difference. In step S2, the attitude sensor 110 detects an inclination of the antenna device of the present invention with respect to the reference plane (e.g., the ground). In step S3, the antenna device (the transceiver circuit 102) determines whether or not the XPR is detected. In step S4, the cross polarization power ratio sensor 111 detects a cross polarization power ratio XPR of an incoming radio wave. In step S5, the antenna device (the transceiver 102) determines, from the cross polarization power ratio XPR between the antenna device and the incoming radio wave, and sets a feed phase difference at which ΔMEG becomes minimum.

In step 3, in a case where implementation of the cross polarization power ratio sensor 111 is desired to be omitted or where processing for detecting a cross polarization power ratio is desired to be omitted even when the cross polarization power ratio sensor 111 is implemented, the antenna device (the transceiver circuit 102) determines in step 6 whether to detect an inclination of the controlled apparatus 501.

When the inclination of the controlled apparatus 501 is detected in step 6, the attitude sensor 504 detects, in step 7, the inclination of the controlled apparatus 501 and transmits a detection result to the antenna device. The antenna device (the transceiver circuit 102) determines the cross polarization power ratio XPR from the inclination detected by the attitude sensor 504 and proceeds to step 5.

FIG. 26 is a view showing example settings of a feed phase difference of the antenna device of the present invention; namely, example setting acquired on the basis of the ΔMEG characteristics shown in FIGS. 17 and 21. When the loop planes of the respective loop antennas 107 and 108 are horizontal to the X-Y plane as shown in FIG. 1, the loop antennas 107 and 108 act as horizontal polarization antennas, and the ground plate 101 acts as a vertical polarization antenna. On the contrary, when the loop planes of the respective loop antennas 107 and 108 are perpendicular to the X-Y plane as shown in FIG. 1, the loop antennas 107 and 108 act as vertical polarization antennas, and the ground plate 101 acts as a horizontal polarization antenna.

As seen from FIGS. 14 and 18, the positional relationship between the human body and the loop antennas 107, 108 and the positional relationship between the human body and the ground plate 101 change depending on the inclination of the antenna device of the present invention. The degree of influence of the human body on the loop antennas 107 and 108 that are magnetic current antennas and the degree of influence of the human body on the ground plate 101 that is an electric current antenna are thereby changed. As is seen from FIGS. 15 and 19, even in the case of the same feed phase difference, the degree of a change in the gain of the electric current antenna component caused by the distance of the antenna device to the human body and the degree of change in gain of the magnetic current antenna component caused by the distance of the antenna device to the human body greatly differ from each other.

The feed phase differences corresponding to the respective XPRs specifically change in accordance with the inclination of the antenna device of the present invention with respect to the ground. Therefore, as shown in FIG. 26, a feed phase difference at which the ΔMEG becomes minimum is determined and set from the inclination of the antenna device of the present invention with respect to the ground and the XPR of the incoming radio wave.

In FIG. 25, when the inclination of the controlled apparatus 501 achieved during operation remains constant at all times and when the cross polarization power ratio XPR does not change much during operation, the cross polarization power ratio XPR can previously ascertained. Hence, processing for detecting the cross polarization power ratio XPR in steps 4 and 7 can be omitted.

Even when the inclination of the controlled apparatus 501 changes during operation, the antenna of the controlled apparatus 501 is configured such that the vertically polarized component and the horizontally polarized component, both of which are emitted from the antenna provided in the controlled apparatus 501, become equal to each other (including a substantially equal state), whereby the cross polarization power ratio XPR remains at about 0 dB at all times without regard to the inclination of the controlled apparatus 501. Therefore, processing for detecting the cross polarization power ratio XPR performed in steps 4 and 7 can be omitted. When the loop planes of the respective loop antennas 107 and 108 are horizontal to the X-Y plane, the feed phase difference of the antenna device of the present invention is set to 150°. When the loop planes of the respective loop antennas 107 and 108 are perpendicular to the X-Y plane, the feed phase difference is set to 90°. Moreover, the distribution of radio waves emitted from the magnetic current antenna and the electric current antenna is controlled by utilization of the feed phase difference according to a preset distribution.

As mentioned above, the feed phase difference is set to an optimum value in accordance with the cross polarization power ratio determined by a polarized wave of an antenna of a controlled apparatus, such as a personal computer, and a propagation environment, whereby a gain change caused by the human body can be reduced.

The antenna device of the present invention has the magnetic current antenna and the electric current antenna, planes of polarization of which cross each other at right angles, and also has a function for adjusting distribution of radio waves emitted from both antennas.

Figure 27:
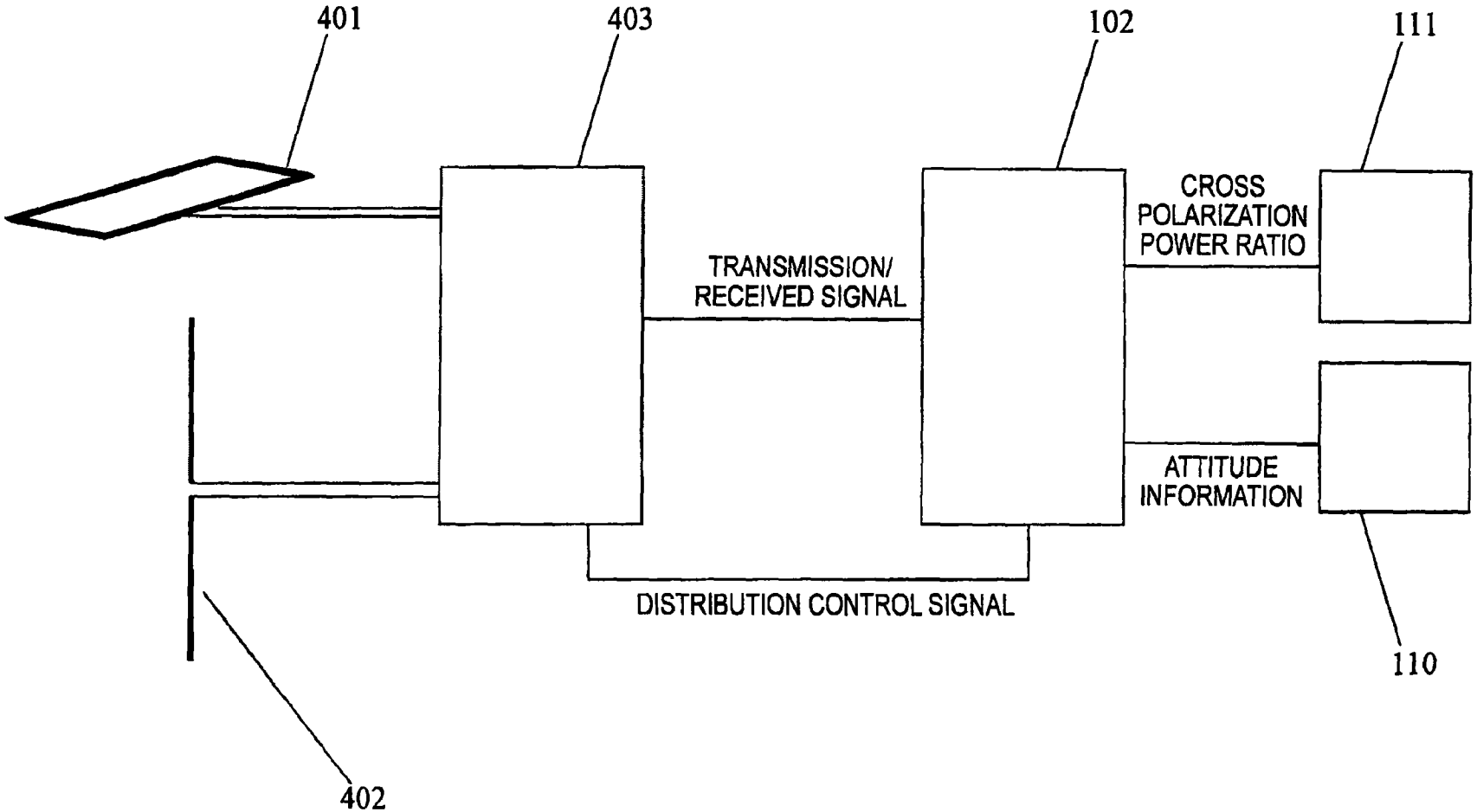
[FIG. 27] It is a view showing the principle of the antenna device of the first embodiment of the present invention.

FIG. 27 is a view showing the principle of the antenna device of the present invention.

A magnetic current antenna 401 is one that takes a magnetic current as a source of emission, such as a loop antenna, a slot antenna, a patch antenna, and an inverted-F antenna.

An electric current antenna 402 is one that takes an electric current as a source of emission, such as a linear antenna and a ground plate. Polarization caused by the magnetic current antenna 401 and polarization caused by the electric current antenna 402 cross each other at right angles. Each of the magnetic current antenna 401 and the electric current antenna 402 may also not be formed from a single antenna element.

An electric current-magnetic current distribution control circuit 403 is circuitry that distributes and outputs a transmission/received signal input from the transceiver circuit 102 in accordance with the distribution of radio waves emitted from the magnetic current antenna 401 and the electric current antenna 402. A distribution proportion of the magnetic current antenna 401 to the electric current antenna 402 is determined from a distribution control signal input by the transceiver circuit 102.

FIG. 1 is equivalent of the case where the magnetic current antenna is built from the loop antennas 107 and 108; where the electric current antenna is made up of the ground plate 101; and where distribution of radio waves emitted from both antennas is controlled by controlling a feed phase difference between the loop antennas 107 and 108. As mentioned above, even when the magnetic current antenna and the electric current antenna are built in a single unit as shown in FIG. 1 or when the magnetic current antenna and the electric current antenna are separately built as shown in FIG. 27, the present invention is not affected.

Finally, the antenna device of the present invention is not limited to the configuration shown in FIG. 1, and the like, and transceivers including the configurations also belong to the present invention.

Although the present invention has been described in detail by reference to the specific embodiment, it is manifest to those skilled in the art that the present invention is susceptible to various alterations or modifications without departing the spirit and scope of the present invention.

The present patent application is based on Japanese Patent Application No. 2007-313258 filed on Dec. 4, 2007; Japanese Patent Application No. 2008-170088 filed on Jun. 30, 2008; and International Patent Application PCT/JP2007/065258 filed on Aug. 3, 2007, the entire subject matters of which are incorporated herein by reference.

Industrial Applicability

An antenna device of the present invention makes it possible to reduce a change in gain caused by a human body. Therefore, the antenna device of the present invention can be applied as an antenna device to be incorporated in; for instance, an apparatus that detects a position for security purpose, an apparatus device that detects a distance, and the like.

The invention claimed is:

1. An antenna device comprising:

a planar ground plate having a ground conductor;

a first loop antenna and a second loop antenna provided at positions separate from the ground plate in a horizontal direction; and a signal feeding section that feeds signals to feeding points provided at one ends of the first loop antenna and the second loop antenna respectively, wherein loop planes formed respectively in the first loop antenna and the second loop antenna are perpendicular to the ground plate;

wherein other ends of the first loop antenna and the second loop antenna are coupled to the ground plate respectively;

wherein a turning direction of the first loop antenna from the feeding point thereof to the ground plate is opposite to a turning direction of the second loop antenna from the feeding point thereof to the ground plate; and wherein polarized waves parallel to the loop planes emitted from the first loop antenna and the second loop antenna are perpendicular to a polarized wave emitted by electric currents flowing from the first loop antenna and the second loop antenna into the ground plate.

2. The antenna device according to claim 1, wherein the loop plane formed by the first loop antenna faces the loop plane formed by the second loop antenna.

3. The antenna device according to claim 2, wherein the first loop antenna and the second loop antenna are arranged at a position where an amount of mutual coupling between the first loop antenna and the second loop antenna becomes −10 dB or less.

4. The antenna device according to claim 3, wherein the signal feeding section controls a phase of the signal fed to the first loop antenna and a phase of the signal fed to the second loop antenna.

5. The antenna device according to claim 4, further comprising:

an attitude sensing section that detects an inclination of the ground plate with respect to a reference plane, wherein the signal feeding section controls the phase of the signal fed to the first loop antenna and the phase of the signal fed to the second loop antenna in accordance with the inclination detected by the attitude sensing section.

6. The antenna device according to claim 5, further comprising:

a cross polarization power ratio sensing section that detects a cross polarization power ratio of an incoming radio wave, wherein the signal feeding section controls the phase of the signal fed to the first loop antenna and the phase of the signal fed to the second loop antenna in accordance with the cross polarization power ratio detected by the cross polarization power ratio sensing section.

7. The antenna device according to claim 5, wherein, when a vertically polarized component and a horizontally polarized component of an incoming radio wave from a wireless apparatus are substantially identical with each other, the signal feeding section controls the distribution of the radio wave emitted from the first loop antenna and the radio wave emitted from the second loop antenna according to a preset distribution.

8. The antenna device according to claim 5, wherein the signal feeding section controls the phase of the signal fed to the first loop antenna and the phase of the signal fed to the second loop antenna so that a margin of gain change falls within a predetermined range.

9. The antenna device according to claim 4, wherein the signal feeding section controls distribution of a radio wave emitted from the first loop antenna and a radio wave emitted from the second loop antenna in accordance with information about an inclination of the wireless apparatus with respect to a reference plane, the information being included in the incoming radio wave from the wireless apparatus.

10. A wireless communication system comprising:

the antenna device according to claim 1; and a wireless apparatus that conducts a wireless communication with the antenna device.

* * * * *